US008926071B2

(12) United States Patent
Sekiya

(10) Patent No.: US 8,926,071 B2
(45) Date of Patent: Jan. 6, 2015

(54) LIQUID-JET RECORDING APPARATUS INCLUDING MULTI-NOZZLE INKJET HEAD FOR HIGH-SPEED PRINTING

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 13/109,489

(22) Filed: May 17, 2011

(65) Prior Publication Data

US 2011/0285786 A1 Nov. 24, 2011

(30) Foreign Application Priority Data

May 18, 2010 (JP) ..... 2010-114594

(51) Int. Cl.
*B41J 2/165* (2006.01)
*B41J 2/185* (2006.01)
*B41J 2/09* (2006.01)

(52) U.S. Cl.
CPC .... *B41J 2/185* (2013.01); *B41J 2/09* (2013.01)
USPC ..... 347/73

(58) Field of Classification Search
None
See application file for complete search history.

(56) References Cited

U.S. PATENT DOCUMENTS

| | | | | |
|---|---|---|---|---|
| 3,373,437 | A | 3/1968 | Sweet et al. | |
| 3,683,212 | A | 8/1972 | Zoltan | |
| 3,747,120 | A | 7/1973 | Stemme | |
| 3,946,398 | A | 3/1976 | Kyser et al. | |
| 4,723,129 | A | 2/1988 | Endo et al. | |
| 5,610,637 | A | 3/1997 | Sekiya et al. | |
| 6,338,545 | B1 | 1/2002 | Sekiya | |
| 6,764,174 | B2 | 7/2004 | Sekiya | |
| 7,150,521 | B2 | 12/2006 | Sekiya | |
| 7,201,464 | B2 | 4/2007 | Sekiya | |
| 7,213,909 | B2 | 5/2007 | Sekiya | |
| 7,413,293 | B2 | 8/2008 | Jeanmaire | |
| 7,445,326 | B2 | 11/2008 | Sekiya | |
| 7,669,988 | B2 * | 3/2010 | Sharma et al. | 347/77 |
| 2002/0122098 | A1 | 9/2002 | Sekiya | |
| 2007/0139454 | A1 * | 6/2007 | Hamasaki et al. | 347/12 |
| 2007/0257971 | A1 * | 11/2007 | Jeanmaire | 347/82 |
| 2010/0194829 | A1 * | 8/2010 | Sekiya | 347/75 |

FOREIGN PATENT DOCUMENTS

| | | |
|---|---|---|
| JP | 2003-89214 | 3/2003 |
| JP | 2010-194765 | 9/2010 |
| JP | 2010-194766 | 9/2010 |
| JP | 2010-195034 | 9/2010 |

* cited by examiner

*Primary Examiner* — Alejandro Valencia
(74) *Attorney, Agent, or Firm* — Cooper & Dunham LLP

(57) ABSTRACT

A liquid-jet recording apparatus includes a liquid-jet recording head unit to jet ink droplets toward a recording medium for printing and including an opening area through which the ink droplets fly out from the liquid-jet recording head unit, and a conveyance unit to convey the recording medium to a fore side of the opening area. The liquid-jet recording head unit includes a multi-nozzle inkjet head, a separation unit, a gas-flow application unit, and a gutter unit. The multi-nozzle inkjet head includes multiple inkjet nozzles, pressurizes ink, and emits a plurality of continuous streams of an ink. The opening area has a slit shape extending along a direction in which the multiple inkjet nozzles are arrayed. An air flow generated in the opening area has a velocity vector directed inward from the opening area.

15 Claims, 15 Drawing Sheets

LIQUID-JET RECORDING APPARATUS INCLUDING MULTI-NOZZLE INKJET HEAD FOR HIGH-SPEED PRINTING

CROSS-REFERENCE TO RELATED APPLICATIONS

The present patent application claims priority pursuant to 35 U.S.C. §119 from Japanese Patent Application No. 2010-114594, filed on May 18, 2010 in the Japan Patent Office, which is hereby incorporated herein by reference in its entirety.

BACKGROUND

1. Technical Field

The present disclosure relates to a liquid-jet recording apparatus, and more specifically to a liquid-jet recording apparatus including a multi-nozzle inkjet head to jet ink droplets for high speed printing.

2. Description of the Background Art

Inkjet printing apparatuses have been recognized as excellent products in the field of digitally-controlled electronic printing because of various advantages, such as low mechanical impact, low noise, and system simplicity. Accordingly, inkjet printing apparatuses have achieved commercial success in the fields of home-use printers, office-use printers, and so on.

Conventionally, two main types of color inkjet printing technologies have been developed: drop-on-demand type and continuous-stream type. In both types of technologies, different color inks are separately supplied through corresponding passages provided in a print head unit. The passages are provided with nozzles through which ink droplets are selectively ejected toward a recording medium. Thus, each type of printing technology needs separate ink supply systems corresponding to respective inks used for printing.

For example, for the continuous-stream-type inkjet printing, a supply source of pressurized ink is used to create a continuous stream of ink droplets. A conventional continuous-stream-type inkjet recording apparatus may employ electrostatic charging devices like that described in U.S. Pat. No. 3,373,437.

The conventional continuous-stream-type inkjet recording apparatus is disposed near a point at which a filamentous ink stream is separated into individual ink droplets, and the ink droplets are charged and guided to a proper position by a deflection electrode having a large potential difference. When printing is not performed, ink droplets are deflected into an ink capture unit (gutter) for reuse or discard. By contrast, when printing is performed, ink droplets reach the recording medium without being deflected. Alternatively, deflected ink droplets reach the recording medium while undeflected ink droplets are collected into the ink capture unit. Such a continuous-stream-type inkjet recording apparatus can operate at higher speed than a drop-on-demand type inkjet recording apparatus, and can form high quality images. However, such a continuous-stream-type inkjet recording apparatus is disadvantageous in high production cost of an electrostatic deflection mechanism employed therein and relatively frequent failures in operation.

Hence, for example, another continuous-stream-type inkjet recording apparatus is proposed like that described in U.S. Pat. No. 7,413,293. For the apparatus, by cyclically applying weak thermal pulses to a continuous stream of ink ejected from a nozzle orifice by heaters, the continuous ink stream is separated into ink droplets. In response to the applied thermal pulses, multiple ink droplets are generated at a position away from the nozzle orifice. The ink droplets are divided into deflected droplets and undeflected (straight-forward) droplets by thermal pulses asymmetrically applied from heaters disposed near an outlet of the nozzle orifice.

Then, the flying direction of the deflected droplets is changed by a gas flow and captured by a collection unit. By contrast, the undeflected droplets impinge the recording medium for printing. Alternatively, the flying direction of undeflected droplets may be changed by a gas flow and collected by the collection unit while the deflected droplets impinge the recording medium for printing. Such a configuration can obviate the electrostatic charging devices of the conventional continuous-stream-type inkjet recording apparatus to improve the control performance of droplet formation.

Further, since the electrostatic charging devices are obviated, the density at which multiples nozzles are arrayed in line can be easily set to a density corresponding to a final print density of 600 dpi to 2400 dpi.

With the proposal of such a continuous-stream-type inkjet recording apparatus as a trigger, development efforts are accelerating for achieving a page-printer-type recording apparatus in which multiple nozzles of an ink ejection head are arrayed in line at such a high density and only a recording medium is conveyed to a print area with the ink ejection head being stationary. Simultaneously, development efforts are accelerating for achieving a continuous-stream-type inkjet recording apparatus according to a new printing principle and solving technical challenges involved.

SUMMARY

In an aspect of this disclosure, there is provided an improved liquid-jet recording apparatus including a liquid-jet recording head unit and a conveyance unit. The liquid-jet recording head unit jets ink droplets toward a recording medium for printing and includes an opening area through which the ink droplets fly out from the liquid-jet recording head unit. The conveyance unit conveys the recording medium to a fore side of the opening area of the liquid-jet recording head unit. The liquid-jet recording head unit includes a multi-nozzle inkjet head, a separation unit, a gas-flow application unit, and a gutter unit. The multi-nozzle inkjet head includes multiple inkjet nozzles, pressurizes ink, and emits a plurality of continuous streams of an ink. The separation unit stimulates surface of the continuous stream of ink and causes surface waves on the continuous stream of ink so that the continuous stream of ink breaks up into streams of flying ink droplets. The gas-flow application unit applies a gas flow to the flying ink droplets from a substantially-vertical direction relative to a flying direction of the flying ink droplets. The gutter unit catches as non-print droplets first ink droplets of the flying ink droplets having a flying path deflected by the gas flow. Second ink droplets of the flying ink droplets having a flying path not substantially deflected by the gas flow hit the recording medium as print droplets without being caught by the gutter unit. The opening area through which the print droplets fly out from the liquid-jet recording head unit has a slit shape extending along a direction in which the multiple inkjet nozzles are arrayed. An air flow generated in the opening area has a velocity vector directed inward from the opening area.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
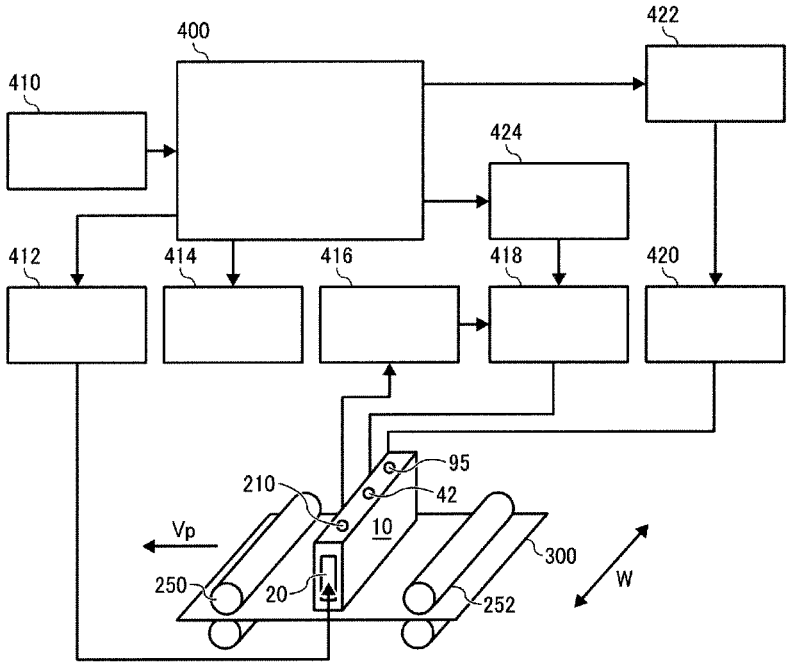
FIG. 1 is a schematic view and block diagram of a liquid-jet recording apparatus.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIG. 1 is a schematic view of a configuration of a liquid-jet recording apparatus according to an exemplary embodiment of the present disclosure.

In FIG. 1, the liquid-jet recording apparatus includes a liquid-jet recording head unit 10, a first conveyance roller 250, a second conveyance roller 252, a controller 400, a print-head driving circuit 412, a conveyance control circuit 414, an ink collection unit 416, an ink supply unit 418, and a gas-flow pressurizing unit 420. Further, in FIG. 4, input data 410 is inputted to the controller 400.

In the present exemplary embodiment, the liquid-jet recording head unit 10 has a plurality of nozzles arranged along a width direction W of a recording medium 300 to cover the width of a recording area of the recording medium 300. With the liquid-jet recording head unit 10 being fixed in the liquid-jet recording apparatus, the recording medium 300 is conveyed in a direction indicated by Vp for high speed printing.

A continuous-stream-type inkjet recording unit has a higher frequency of forming ink droplets than a drop-on-demand-type inkjet recording unit and is therefore more suitable for high-speed printing, high throughput, and large-volume printing. Such advantage of the continuous-stream-type inkjet recording unit can be maximized by employing the above-described configuration in which the recording medium 300 is conveyed with the liquid-jet recording head unit 10 being fixed in the liquid-jet recording apparatus.

More preferably, in order to take full advantage of the high frequency of droplet formation, the recording medium 300 may be conveyed as a continuum, e.g., a roll sheet that is supplied in a roll shape and conveyed in a belt shape at high speed rather than conveyed sheet by sheet as a cut sheet.

With such a configuration, for example, when the plurality of nozzles is arranged in a density corresponding to a print density of 600 dpi (dots per inch) to 2400 dpi, the liquid-jet recording head unit 10 can print at least about 50 sheets per minute or at most about 3,000 sheets per minute.

For example, in a case in which a drop-on-demand-type recording head (e.g., a thermal inkjet type) is employed as the liquid-jet recording head unit 10, the liquid-jet recording head unit 10 can print about 50 to 200 sheets per minute. However, in a case in which the above-described continuous-stream-type recording head is employed as the liquid-jet recording head unit 10, the liquid-jet recording head unit 10 can print about 300 to 3000 sheets per minute, which is one order of magnitude greater than the drop-on-demand-type recording head.

The number of sheets referred herein is calculated based on A4-size sheet, and it is not that at most 3000 cut sheets of A4 size are in fact obtained but that the liquid-jet recording head unit 10 can print areas of an uncut belt-shaped recording medium corresponding to at most 3000 sheets of A4 size. If A4-size cut sheets are in fact printed, the number of sheets obtained would be less than 3000 sheets.

In passing the print area, the recording medium 300 as the continuum is conveyed in belt shape at high speed and then cut into printed sheets. Alternatively, cut sheets may be prepared as the recording medium 300 in advance, conveyed, and printed sheet by sheet. In such a case, the number of sheets printed per minute is less than in the case of the belt-shaped recording medium.

It is to be noted that the liquid-jet recording apparatus is not necessarily limited to the above-described configuration and may be a serial-print-type configuration in which a carriage mounted with the liquid-jet recording head unit 10 scans the recording medium for printing.

Alternatively, the continuous-stream-type inkjet recording unit may be combined with another recording unit using a print method suitable for large-area (large-sheet-size) printing, such as surface printing, planographic printing, plate printing, or stencil printing so that each recording unit bears part of the printed area. For example, areas common among all sheets are printed with another recording unit using a conventional printing method, such as surface printing, planographic printing, plate printing, or stencil printing. Meanwhile, areas in which printing information is different among sheets (for example, address information) are printed with the continuous-stream-type inkjet recording unit in accordance to printing information.

In such a case, it is preferable that the continuous-stream-type inkjet recording unit and the other recording unit use a common conveyance unit. To use the common conveyance unit, the liquid-jet recording apparatus includes a sensor to detect conveyance of the recording medium. In accordance with data detected by the sensor, the continuous-stream-type inkjet recording unit according to the present exemplary embodiment is controlled by a controller so as to jet ink droplets for printing at timings suitable for a conveyance speed of printing at the other recording unit.

Figure 2:
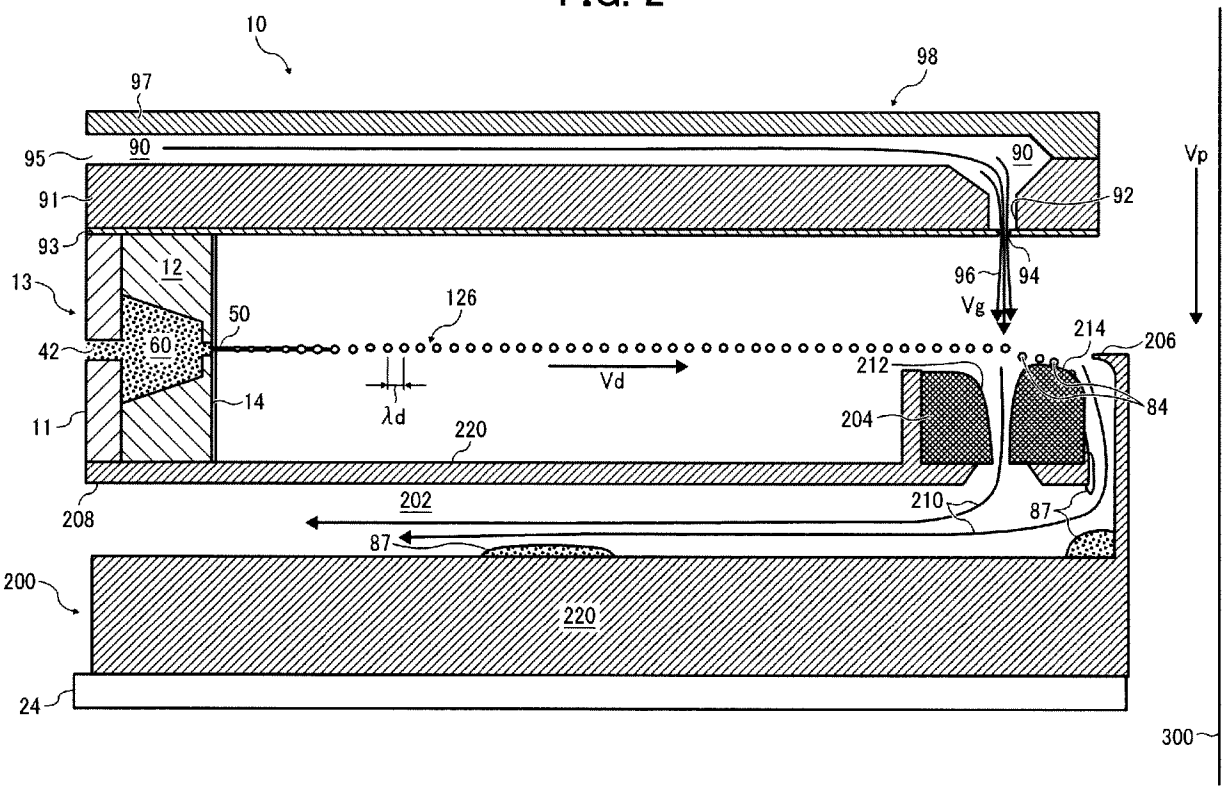
FIG. 2 is a sectional view of a liquid-jet recording head unit illustrated to explain a conventional print principle.

FIG. 2 is a cross-sectional view of a liquid-jet recording head unit illustrated to describe a print principle of a conventional continuous-stream-type inkjet recording unit. In FIG. 2, the liquid-jet recording head unit 10 includes a print-head back plate 11, a print-head chamber manifold 12, a nozzle plate 14, a print-head support 24, an ink inlet 42, a nozzle orifice 50, a pressurized ink 60, collected ink droplets 84 collected with a gutter 206, a collected ink 87, a pressurized gas flow 90, a gas-supply manifold 91, a gas supply passage 92, a gas-jet nozzle plate 93, a gas-jet nozzle orifice 94, a pressurized-air-flow inlet 95, a gas flow 96, a gas-supply manifold cover 97, a gas-flow supply unit 98, flying ink droplets 126 separated from a continuous ink stream, an ink collection unit 200, an ink collection passage 202, a porous member 204, an ink suctioning portion 208, a suctioned gas flow 210, a suction slot 212, and an ink suction manifold 220. As described above, FIG. 2 is the cross-sectional view of the liquid-jet recording head unit, and practically multiple nozzle orifices 50 are arranged in a depth direction of FIG. 9 (i.e., a direction perpendicular to a flat face of a sheet on which FIG. 2 is printed).

In this configuration, the pressurized ink 60 is introduced from the ink inlet 42 to the print-head chamber manifold 12, jetted from the inkjet nozzle orifice 50, and broken into ink droplets flying at a speed of Vd. Some ink droplets go straight without being deflected and strike the recording medium 300 to form a print image. In FIG. 2, the recording medium 300 is conveyed in a direction indicated by an arrow at a speed of Vp. Alternatively, the recording medium 300 may be conveyed in the opposite direction.

By contrast, other ink droplets are deflected toward the direction perpendicular to the flat face of the sheet on which FIG. 2 is printed (i.e., the direction in which the multiple nozzle orifices 50 are arranged) by a unit described below, further deflected toward a downward direction by the gas flow 96 jetted from the gas-jet nozzle orifice 94 at a speed of Vg, trapped and collected by the suction slot 212 or the gutter 206, and accumulated as the collected ink 87.

In this configuration, when the ink droplets deflected without being used for printing are further deflected toward suction slot 212 or the gutter 206, flowing (suctioning) of the suctioned gas flow 210 at the ink suctioning portion 208 allows more reliable collection of ink droplets.

The above-described example of printing with droplets going straight and collection of deflected droplets is one principle of operation in the continuous-stream-type inkjet recording unit according to the present exemplary embodiment. It is to be noted that the principle of printing and collection is not limited to the above-described one and may be any other suitable one as described below.

Next, an example of the condition for jetting ink droplets in the continuous-stream-type inkjet recording unit is described below. In the present exemplary embodiment, the pressurized ink 60 is jetted from the inkjet nozzle orifice 50 at a pressure of approximately 0.2 to 1 MPa so that the flying speed Vd of ink droplets ranges from approximately 15 to 30 m/s. The pressure and speed is associated with the frequency in applying thermal pulses and the diameter D of one ink droplet. Typically, uniform ink droplets can be obtained by setting so that the value of $\lambda d/D$ falls into a range from 4 to 6.

At the inkjet nozzle orifice 50 and the surrounding area, independently driven heaters are formed by a thin film formation unit at the left and right sides of the inkjet nozzle orifice 50 seen from the outlet thereof.

The multiple nozzle orifices 50 accompanied by the independently driven heaters are arranged at a certain interval. The interval between the nozzle orifices 50 is associated with the print density of a resultant image and set to be in a range of, for example, 42.3 to 10.6 μm (corresponding to print densities of 600 to 2400 dpi). The size Dd of each nozzle orifice 50 corresponding to the interval ranges from $\phi$23 μm to $\phi$5 μm. The depth of the inkjet nozzle orifice 50 (thickness of a nozzle portion) ranges from approximately 20 to 3 μm. The acceptable dimensional accuracy (tolerance) is approximately +/−0.2 μm, and the roughness of a wall surface of the inkjet nozzle orifice 50 is not more than 0.1 μm.

The multiple nozzle orifices 50 are formed in a so-called multi-nozzle plate. For the multi-nozzle plate, for example, an area from a common slot serving as the ink inlet to a tip of each nozzle orifice can be formed by processing, for example, a Si substrate by a combination of semiconductor processing techniques, such as anisotropic etching, isotropic etching, wet etching, and dry etching.

The above-described heaters formed around the outlet of the inkjet nozzle orifice 50 and address electrodes connected to the heaters can be formed by a combination of thin film formation technologies, such as deposition and sputtering, photolithography, and etching technology as, for example, thin-film heaters including heating material, such as tantalum nitride or hafnium boride and an electrode pattern made of, e.g., aluminum. Ink passages of the nozzle orifices 50 and the surfaces of the heaters and electrodes are coated with a thin file of a silicon oxide or a silicon nitride so as not to be corroded by ink.

For the continuous-stream-type inkjet recording unit, when pressurized ink is jetted as a continuous ink stream (also referred to as ink pole) from each minute nozzle of the recording head unit, the continuous ink stream is naturally separated from the tip thereof into ink droplets (which may be called "natural particulation"). Such natural separation (formation) of ink droplets is unstable and the mass or flying speed of the ink droplets formed is not uniform, which cannot be used for inkjet printing.

By contrast, when a continuous ink stream is jetted from a minute nozzle of the recording head unit according to this exemplary embodiment, the above-described heaters apply thermal stimulation to the surface of continuous ink stream. As a result, standing waves are formed on the surface of continuous ink stream, thus allowing the ink droplets separated from the tip of continuous ink stream to have the same mass and flying speed. In other words, the heaters serve as a separation unit that stimulates a surface of the continuous stream of ink and causes surface waves on the surface of the continuous stream of ink so that the continuous stream of ink breaks up into streams of droplets. In such a case, it is preferable that thermal stimulation is evenly applied from left and right heaters to the surface of continuous ink stream. If the intensity of thermal stimulation (applied thermal energy) is different between the left and right heaters, the symmetry of the flying direction of ink droplets is lost. As a result, the ink droplets fly deflected to the left or right side.

Figure 3:
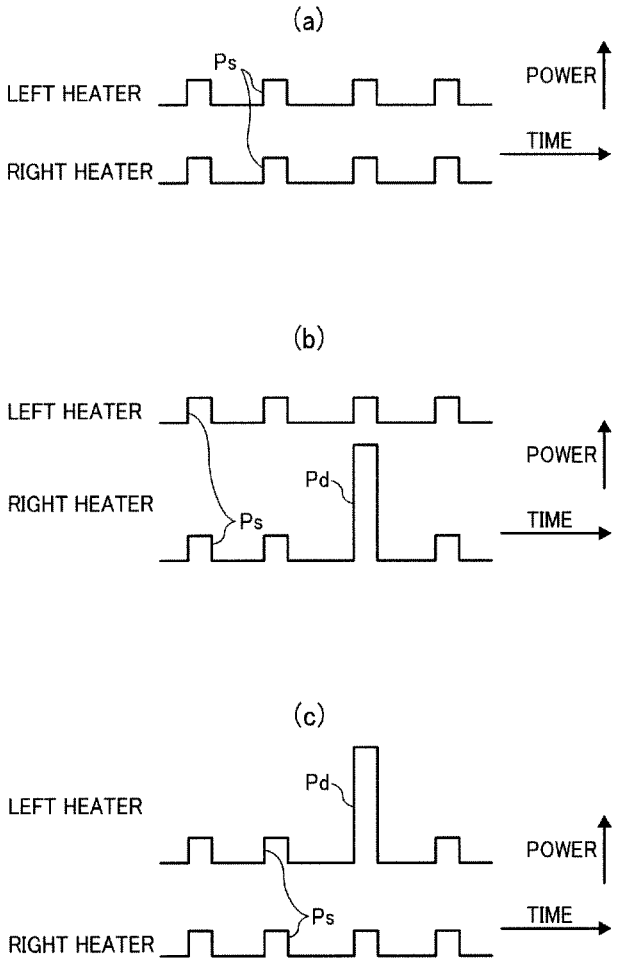
FIG. 3A is a diagram of an example of thermal pulses for forming undeflected ink droplets.
FIG. 3B is a diagram of an example of thermal pulses for forming deflected ink droplets.
FIG. 3C is a diagram of an example of thermal pulses for forming deflected ink droplets.

FIGS. 3A to 3C shows methods of applying driving voltage pulses to the left and right heaters near the inkjet nozzle orifice 50. The term "POWER" in FIGS. 3A to 3C represents driving voltage.

In FIG. 3A, the same driving pulse is applied to each of the left and right heaters. In this case, since the symmetry of the continuous ink stream is maintained, the thermal stimulation allows uniform particulation of ink droplets. Unlike the unstable state of natural particulation, standing waves are generated in the surface of continuous ink stream, thus forming uniform ink droplets. The continuous ink stream and ink droplets go straight with the bilateral symmetry being maintained.

The driving pulse is applied at a frequency of approximately 100 kHz to approximately 300 kHz, and the heating energy per pulse is, for example, approximately 0.1 μJ to approximately 10 μJ. Ink droplets are formed in response to the frequency of the heating driving pulse. The number of ink droplets formed from each nozzle per second is, for example, $1\times10^5$ to $3\times10^5$.

In FIG. 3B, a higher energy pulse Pd than a standard energy pulse Ps is applied to the right heater. As a result, the continuous ink stream and ink droplets lose the bilateral symmetry and are deflected to the left-heater side.

In FIG. 3C, the higher energy pulse Pd than the standard energy pulse Ps is applied to the left heater. As a result, the continuous ink stream and ink droplets lose the bilateral symmetry and are deflected to the right-heater side. Hence, in the present exemplary embodiment, as described above, undeflected ink droplets and deflected ink droplets can be selectively formed. Next, a description is given of a way in which the undeflected ink droplets and deflected ink droplets are turned into printing droplets and non-printing droplets, respectively.

As described above, ink droplets formed from the tip of continuous ink stream go straight or are deflected by applying the same thermal stimulation from the left and right heaters to the continuous ink stream or changing the balance of thermal stimulation between the left and right heaters.

Here, for example, in a case in which the inkjet nozzle orifice 50 and the gas-jet nozzle orifice 94 are positioned so that the gas flow 96 illustrated in FIG. 2 strikes the laterally-deflected ink droplets, the ink droplets are deflected toward a vertical direction (a flowing direction of a gas flow indicated by Vg in FIG. 2) in addition to the lateral deflection, enters the suction slot 212 or the gutter 206 illustrated in FIG. 2, and collected as non-printing droplets, that is, collected ink. In such a case, the multiple nozzle orifices 50 are arranged in a line at a certain density to form the multi-nozzle inkjet head unit. The gas-jet nozzle orifices 94 are arranged in a line at the same density as the density of the inkjet nozzle orifice 50.

By contrast, undeflected ink droplets go straight through an area in which the gas flow 96 does not flow. As a result, the undeflected ink droplets continues to go straight without being influenced by the gas flow 96 so as to fly above the gutter 206 without contacting the gutter 206 and impinge the recording medium 300. Thus, the undeflected ink droplets are used as printing droplets to form a desired image on the recording medium 300.

Next, another exemplary embodiment is described. In the above-described configuration, the gas-jet nozzle orifices 94 are arranged corresponding one by one to the inkjet nozzle orifices 50. As described above, in the present exemplary embodiment, the lateral symmetry of the continuous ink stream can be skewed using the left and right heaters so that the continuous ink stream is deflected. For example, as in this configuration, the continuous ink stream may be deflected by thermal stimulation, and additionally ink droplets may be laterally deflected by the gas flow 96 and collected in the gutter 206. In such a configuration, the gas-jet nozzle orifices 94 may be arranged so that each of the gas-jet nozzle orifices 94 corresponds to every two of the inkjet nozzle orifices 50.

Thus, of ink droplets emitted from the inkjet nozzle orifices 50, undeflected ink droplets are used for printing. By contrast, ink droplets deflected to the left or right side by thermal stimulation and further deflected toward the gutter 206 by the gas flow 96 are not used for printing. For such a configuration, a single gas flow 96 corresponding to two rows of ink droplets can be used for collection of ink droplets in the gutter 206. Accordingly, the gas-jet nozzle orifices 94 can be arranged so that each of the gas-jet nozzle orifices corresponds to every two of the inkjet nozzle orifices 50.

Next, another example is described.

In this configuration, the gas-jet nozzle orifices 94 are arranged corresponding one by one to the inkjet nozzle orifice 50 and each of the gas-jet nozzle orifices 94 is disposed above a row of undeflected ink droplets. Further, the inkjet nozzle orifices 50 and the gas-jet nozzle orifices 94 are positioned so that the gas flow 96 strikes the undeflected ink droplets.

The undeflected ink droplets are deflected by the gas flow 96 toward the gutter 206 and collected in the gutter 206 the gutter 206. By contrast, ink droplets deflected by thermal stimulation fly without being influenced by the gas flow 96, pass over the gutter 206, impinge the recording medium 300, and printed as print droplets on the recording medium 300.

Still another example is described below.

In the above-described three examples, the pulse width of a driving waveform of each heater is maintained constant to form uniform ink droplets particulated by thermal stimulation, and the uniform ink droplets are used for printing or collected in the gutter 206.

Unlike the above-described examples, for example, the pulse width or interval of the driving waveform of each heater may be changed in response to print information to change the mass of ink droplets separated from a continuous ink stream. Thus, different sizes (masses) of ink droplets can be formed and hit by a gas flow from a direction substantially perpendicular to the flying direction of ink droplets so as to be deflected for printing.

As a result, a smaller mass of ink droplets is largely deflected by the gas flow while a larger mass of ink droplets goes substantially straight without being so much deflected by the gas flow. As a result, the smaller mass of ink droplets is deflected and collected to the gutter 206, and the larger mass of ink droplets impinges the recording medium 300 for printing. In this configuration, the symmetry of the continuous ink stream need not be laterally skewed by thermal stimulation of the heater.

Figure 4:
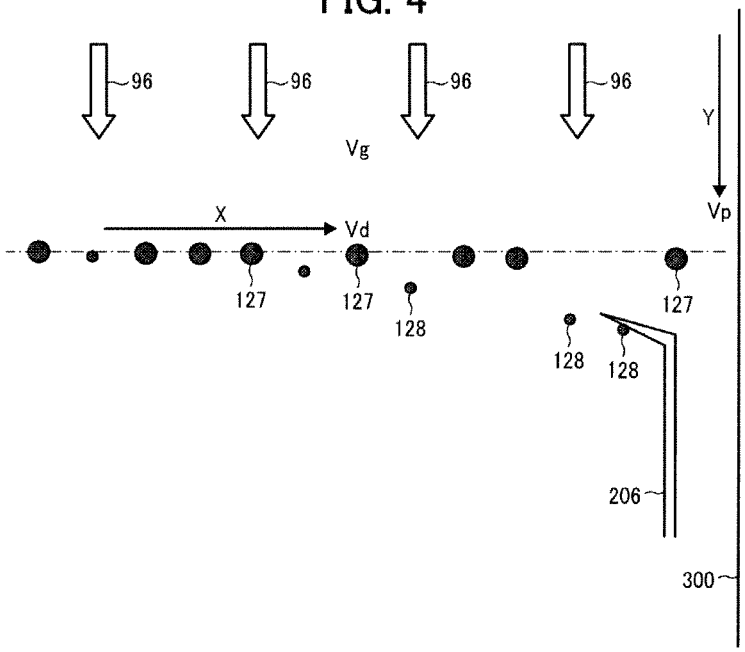
FIG. 4 is a diagram of flying behavior of ink droplets near a gutter in an inkjet printing principle applicable to an exemplary embodiment of the present disclosure.

FIG. 4 is an enlarged view of ink droplets flying near the gutter 206 illustrated in FIG. 2.

In FIG. 4, ink droplets formed by the liquid-jet recording head are divided into tow types of ink droplets: a larger mass of print droplets (larger droplets) 127 and a smaller mass of non-print droplets (smaller droplets) 128 formed in response to image print information. The ink droplets fly at a speed Vd in a direction (ink-droplet flying direction) indicated by an arrow X in FIG. 4.

Here, the gas flow 96 is supplied from a direction substantially perpendicular to the ink-droplet flying direction X. The gas flow 96 is formed in the form of air curtain in a vertical direction (depth direction) with respect to a flat face of a sheet on which FIG. 4 is printed, that is, a direction (multi-nozzle array direction) in which multiple nozzle orifices are arranged in line in the recording head. The gas flow 96 having the form of air curtain is jetted from a slit extending parallel to the multi-nozzle array direction to hit the ink droplets 127 and 128.

The smaller mass of non-print droplets 128 is largely deflected by the gas flow 96 and caught in the gutter 206. By contrast, the larger mass of print droplets 127 is not so much deflected by the gas flow 96, flies over the gutter 206, and attached to the recording medium 300 for printing. In FIG. 4, an alternate long and short dashed line indicates a flying path of ink droplets obtained when the gas flow 96 is not applied to the ink droplets, and the larger mass of print droplets 127 flies slightly deviated from the flying path.

In the above description, the printing of the continuous-stream-type multi-nozzle inkjet recording unit is described using four examples. Next, a configuration of the recording unit is described in more details. In any of the above-described examples, heaters apply thermal stimulation to a continuous ink stream generated by pressurizing ink to form ink droplets or skew the symmetry of the continuous ink stream. In addition, the gas flow 96 half-forcefully drops ink droplets into the gutter 206.

In particular, it is preferable to apply the gas flow 96 to non-print droplets at high precision without hampering the flying of ink droplets for printing so as to reliably direct non-print droplets toward the gutter 206.

Hence, the gas-jet nozzle orifices 94 have a nozzle shape having substantially the same size as that of the inkjet nozzle orifices 50 and processed at substantially the same precision as that of the inkjet nozzle orifices 50. Accordingly, the gas-jet nozzle orifices 94 can be formed by a production technique similar to the production technique of the multi-nozzle plate in which the inkjet nozzle orifices 50 are arrayed.

For example, the size Dg of the gas-jet nozzle orifices 94 may be from $\phi$25 μm to $\phi$8 μm corresponding to a print density of 600 dpi to 2400 di. The thickness of a nozzle portion of each gas-jet nozzle orifice 94 (in the depth direction in FIG. 2) may be, for example, 30 μm to 3 μm. The gas-jet nozzle orifices 94 are arrayed parallel to a direction in which the inkjet nozzle orifices 50 are arrayed in line.

Even in the case in which larger and smaller ink droplets are formed and a gas flow is jetted from a common slit, it is not necessarily needed to jet the gas flow at the same precision as in the case in which the gas flow is jetted from each of the gas-jet nozzle orifices 94. However, as the size of the slit (in the short direction), for example, a dimensional accuracy of approximately 50 μm to 100 μm (+/−1 μm) may be needed to reliably blow the gas flow in the form of air curtain. The wall faces of the gas-jet nozzle orifices 94 preferably has a degree of smoothness equivalent to that of the gas-jet nozzle orifices 94, and the surface roughness of the gas-jet nozzle orifices 94 is preferably 0.1 μm or lower. Further, preferably, foreign substances are not included in or attached to the gas-jet nozzle orifices 94.

It is further preferably to blow a gas flow from the gas-jet nozzle orifices 94 formed at high precision so as to reliably hit non-print droplets. Alternatively, in the case in which the common silt is used, it is further preferably to blow a gas flow in the form of air curtain while reducing a variation in the flow speed of the gas flow. As described above, the continuous-stream-type inkjet recording apparatus forms ink droplets at a high frequency and is suitable for high-speed printing, high throughput, and mass printing. Accordingly, when recording media, such as sheets of paper, are conveyed at high speed, paper dust including fine particles such as cellulose of paper and/or calcium carbonate of coating material is continuously roiled in the continuous-stream-type inkjet recording apparatus. Besides the paper dust generated from the recording medium, other foreign substances, such as fibrous substances and particulate substances, float in the air. If such foreign substances attach near the gas-jet nozzle orifices 94, desired jetting of the gas flow may be hampered. Alternatively, in the case in which the common slit is used for the gas flow, such foreign substances may cause a local variation in the flow speed of the gas flow blown in the form of air curtain.

In this area, minute ink droplets are continuously flying and the moisture of the ink droplets increases the ambient humidity. As a result, such foreign substances tend to aggregate and enlarge, thus creating a condition in which such foreign substances easily adhere near the gas-jet nozzle orifices 94 or the common slit.

Figure 5:
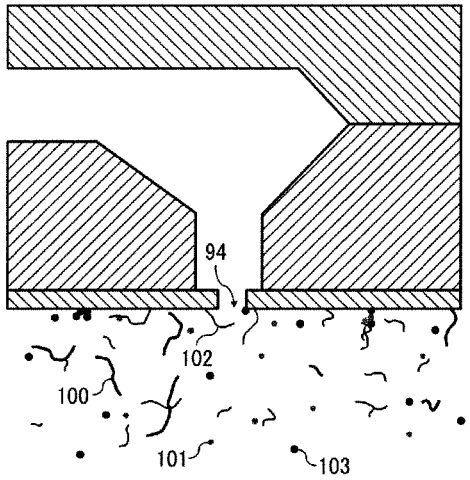
FIG. 5 is an enlarged view of a gas-jet nozzle orifice and the nearby area of a liquid-jet recording head unit according to an exemplary embodiment of the present disclosure.

FIG. 5 is an enlarged cross-sectional view of the gas-jet nozzle orifice 94 illustrated in FIG. 2 and the surrounding area.

In FIG. 5, for example, cellulose 100, fine particle powders 101, fibrous substances, and particulate substances 103 are floating separately from and/or in aggregate with each other near the gas-jet nozzle orifice 94 or adhered around the gas-jet nozzle orifice 94 (or the common slit).

As illustrated in FIG. 5, if foreign substances are adhered around the gas-jet nozzle orifice 94 and hampers favorable jetting of a gas flow, the gas flow may not precisely hit and turn ink droplets into non-print droplets (collected ink). In such a case, unnecessary ink droplets impinge and adhere to the recording medium 300, thus degrading image quality. Alternatively, in the case of the common slit, such adherence of foreign substances causes a local variation in the flow speed of the gas flow blown in the form of air curtain, thus hampering reliable collection of smaller ink droplets. As a result, uncollected smaller ink droplets impinge and adhere to the recording medium 300, thus degrading image quality.

If the flow direction of the gas flow is skewed, the gas flow hampers desired flying of ink droplets for printing, thus degrading image quality. Further, foreign substances may fully seal the gas-jet nozzle orifice 94. In such a case, jetting of the gas flow is hampered, thus degrading image quality.

When the gas flow is continuously jetted from the gas-jet nozzle orifice 94, such adherence of foreign substances and resultant sealing of the gas-jet nozzle orifice 94 can be prevented. However, when printing operation and jetting of the gas flow are stopped, foreign substances tend to adhere around the gas-jet nozzle orifice 94.

To cope with such challenges, in the present exemplary embodiment, during non-printing period, the gas-jet nozzle orifice 94 is sealed and shielded from an ambient atmosphere of a print area in which the recording medium 300 is conveyed and printed. Likewise, even when the common slit is employed instead of the gas-jet nozzle orifices 94 independent of each other, such adherence of foreign substances occurs. Therefore, a gas-jet nozzle cap unit 110 described below can be applied to not only the gas-jet nozzle orifices 94 but also the common slit, thus producing similar effects.

Figure 6:
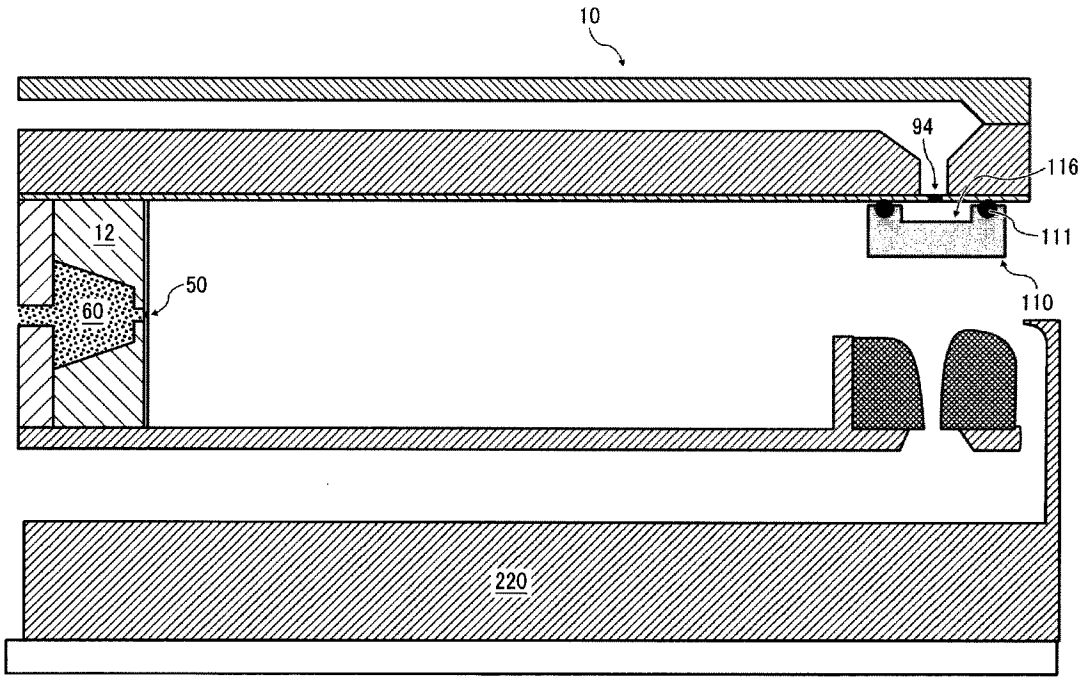
FIG. 6 is a schematic view of a configuration in which the gas-jet nozzle orifice of the liquid-jet recording head unit is shielded from an ambient atmosphere of a recording medium.

FIG. 6 is an example of the gas-jet nozzle cap unit 110.

In FIG. 6, the multiple gas-jet nozzle orifices 94 are arrayed in a vertical direction with respect to a flat face of a sheet on which FIG. 6 is printed (a depth direction of FIG. 6). The gas-jet nozzle cap unit 110 collectively seals and shields the gas-jet nozzle orifices 94 from the ambient atmosphere of the print area of the recording medium 300 in which cellulose, paper dust such as fine particle powder, fibrous or particulate substances and so on are floating. The gas-jet nozzle cap unit 110 has a single recessed portion 116 of a slit shape opposing the gas-jet nozzle orifices 94 in the depth direction of FIG. 6. In such a configuration, the gas-jet nozzle orifices 94 may be sealed and shielded from the ambient atmosphere of the print area of the recording medium 300 via an airtight elastic member 111 of, e.g., an O-ring shape made of a chemical-resistant material, such as fluororubber, thus effectively enhancing air sealing performance.

Figure 7:
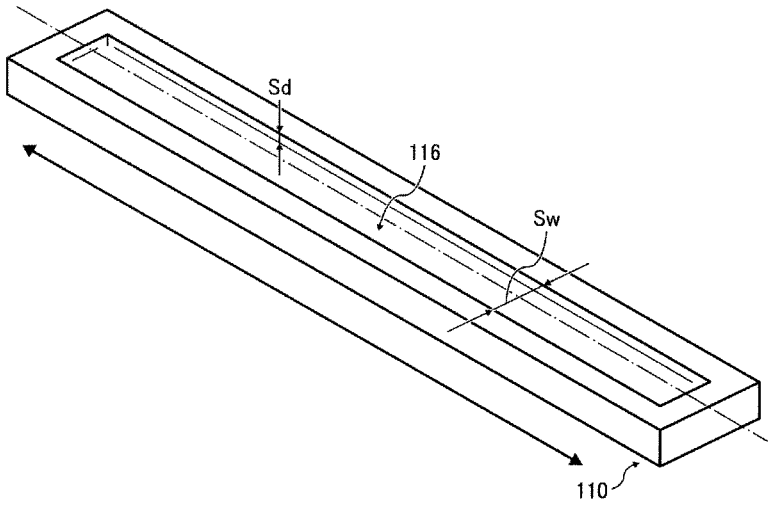
FIG. 7 is a perspective view of a gas-jet nozzle cap unit to shield the gas-jet nozzle orifice from the ambient atmosphere of the recording medium.

FIG. 7 is a perspective view of the gas-jet nozzle cap unit 110 seen from a side of a portion opposing the gas-jet nozzle orifices 94. In FIG. 7, an O-ring and an O-ring slit are omitted for simplicity.

The recessed portion 116 is formed so that the long direction thereof (indicated by a double arrow in FIG. 7) is parallel to a nozzle array direction in which the gas-jet nozzle orifices 94 are arrayed in line. Further, when the recessed portion 116 is installed to cover the gas-jet nozzle orifices 94, the recessed portion 116 is fixed so that a center line of the gas-jet nozzle cap unit 110 indicated by an alternate short and long dashed line C in FIG. 7 substantially matches the line of the gas-jet nozzle orifices 94. The recessed portion 116 has a width Sw of e.g., 150 μm to 2 mm greater than a size Dg of the gas-jet nozzle orifices 94 or a size of the common slit in the short direction. The recessed portion 116 also has a depth Sd of e.g., 100 μm or greater. Such a configuration prevents the gas-jet nozzle cap unit 110 from contacting and damaging an outlet portion of the gas-jet nozzle orifice 94.

Such a configuration also allows use of an increased number of the gas-jet nozzle orifices 94. Accordingly, even when the distance of an area at which the gas-jet nozzle orifices 94 are arrayed in line is increased with the increased number of the gas-jet nozzle orifices 94, the arrayed area of the gas-jet nozzle orifices 94 is securely shielded from the ambient atmosphere of the print area of the recording medium 300.

Figure 8:
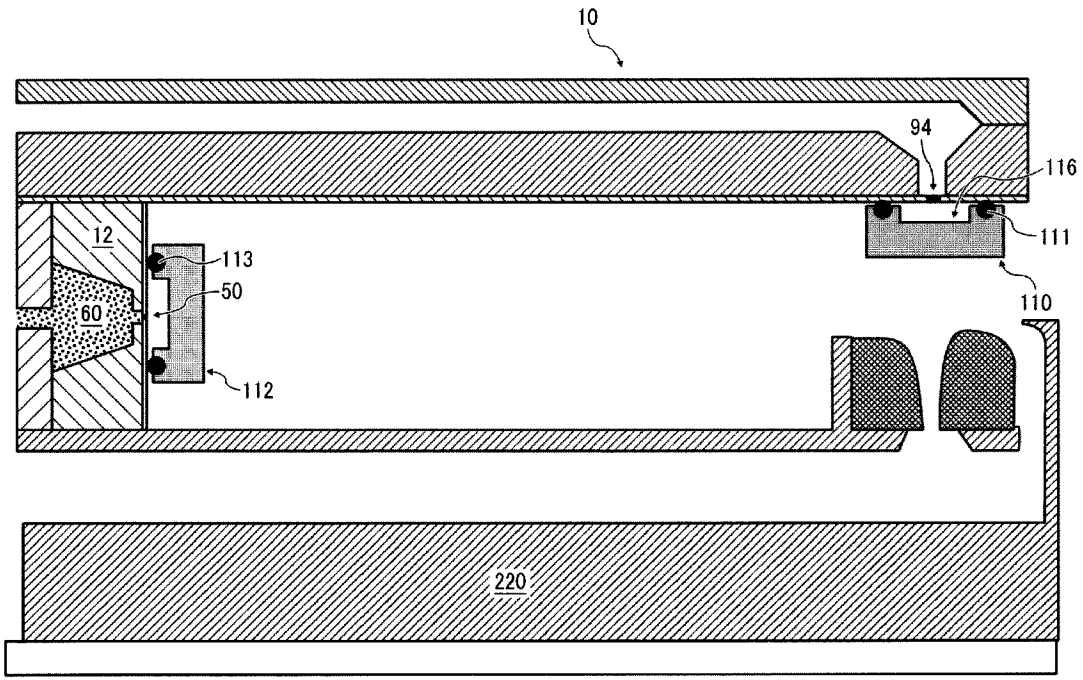
FIG. 8 is a schematic view of a configuration in which, in addition to the gas-jet nozzle cap unit, an inkjet nozzle cap unit is disposed to cover an inkjet nozzle orifice of the liquid-jet recording head unit during non-print period to prevent clogging.

FIG. 8 illustrates still another example.

In FIG. 8, besides the gas-jet nozzle cap unit 110 collectively sealing the multiple gas-jet nozzle orifices 94, the multiple inkjet nozzle orifices 50 arrayed in line in the depth direction of FIG. 6 is covered by an inkjet nozzle cap unit 112 when printing is not performed, thus preventing the multiple inkjet nozzle orifices 50 from being clogged by dried ink or adherence of external foreign substances. In such a case, the inkjet nozzle cap unit 112 covers the multiple inkjet nozzle orifices 50 via an airtight elastic member 113 of, e.g., an O-ring shape made of a chemical-resistant material, such as fluororubber.

As with the gas-jet nozzle cap unit 110, the inkjet nozzle cap unit 112 also has a single recessed portion of a slit shape opposing the multiple inkjet nozzle orifices 50 in the depth direction of FIG. 8 to collectively cover the multiple inkjet nozzle orifices 50. The recessed portion of the slit shape is formed so that thereof is parallel to the direction in which the multiple inkjet nozzle orifices 50 are arrayed in line. The long direction of the recessed portion of the inkjet nozzle cap unit 112 is also parallel to the long direction of the recessed portion 116 of the gas-jet nozzle cap unit 110.

Figure 9:
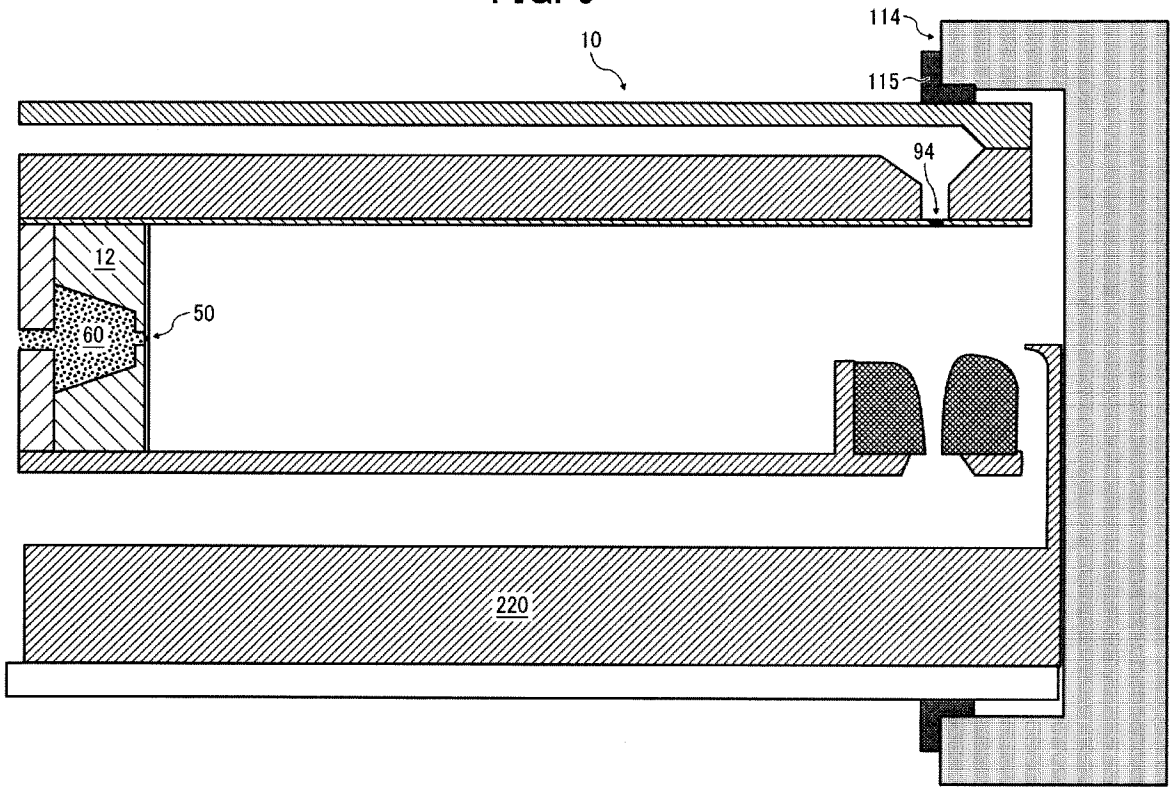
FIG. 9 is a schematic view of a common cap unit to collectively shield the gas-jet nozzle orifice and the inkjet nozzle orifice from an ambient atmosphere of a recording medium.

FIG. 9 shows still another example.

In FIG. 9, a common cap unit 114 simultaneously seals and shields the gas-jet nozzle orifices 94 (or the common slit) and the multiple inkjet nozzle orifices 50 from the ambient atmosphere of the print area of the recording medium 300 in which cellulose, paper dust such as fine particle powder, fibrous or particulate substances and so on are floating.

The common cap unit 114 has a single recessed portion 117 of a slit shape in the depth direction of FIG. 9 at a side opposing a front side of the continuous-stream-type liquid-jet print head 10 (to which the recording medium 300 is conveyed). The long direction (the depth direction of FIG. 9) of the recessed portion 117 is parallel to the direction in which the multiple gas-jet nozzle orifices 94 are arrayed in line or the long direction of the common slit. The long direction of the recessed portion 117 is also parallel to the direction in which the multiple inkjet nozzle orifices 50 area arrayed in line.

The common cap unit 114 seals the gas-jet nozzle orifices 94 (or the common slit) and the multiple inkjet nozzle orifices 50 via airtight elastic members 115 of, e.g., an O-ring shape made of a chemical-resistant material, such as fluororubber.

Figure 10:
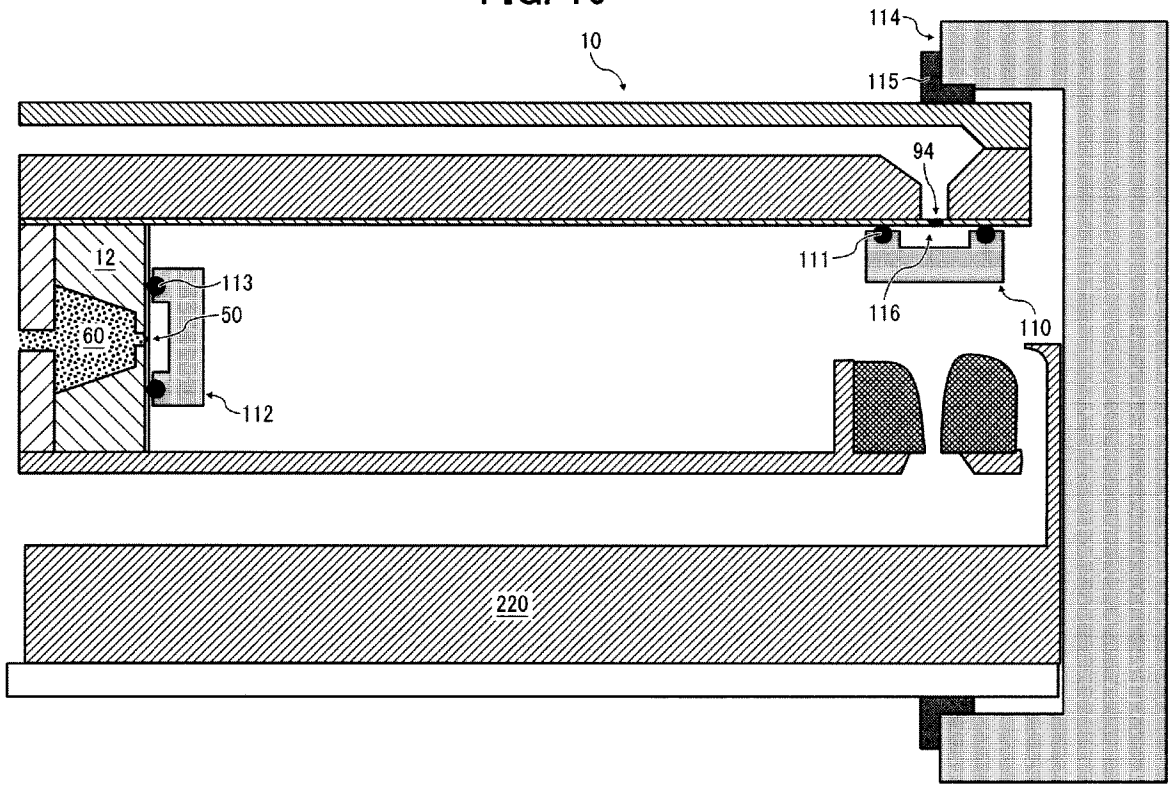
FIG. 10 is a schematic view of a configuration in which the gas-jet nozzle cap unit and the inkjet nozzle cap unit of FIG. 8 and the common cap unit of FIG. 9 are disposed to more completely shield the gas-jet nozzle orifice from the ambient atmosphere of the recording medium.

FIG. 10 shows still another example.

In FIG. 10, in addition to the common cap unit 114 shown in FIG. 9, the gas-jet nozzle cap unit 110 and the inkjet nozzle cap unit 112 are disposed to seal the gas-jet nozzle orifices 94 and the multiple inkjet nozzle orifices 50, respectively. Such a configuration can further effectively prevent clogging of the multiple inkjet nozzle orifices 50 and seal and shield the gas-jet nozzle orifices 94 from the ambient atmosphere of the print area of the recording medium.

As described above, the vicinity of the gas-jet nozzle orifices 94 or the common slit is shielded from the ambient atmosphere of the print area of the recording medium, thus jetting the gas flow 96 at high precision.

As described above, in the present exemplary embodiment, it is preferable to jet the gas flow 96 from the gas-jet nozzle orifices 94 so as to accurately hit ink droplets to drop the ink droplets into the gutter 206 for collection. Alternatively, in the case in which smaller and larger ink droplets are formed in accordance to image information and the gas flow is blown in the form of air curtain from the common slit, it is also preferable to accurately drop the smaller ink droplets into the gutter 206 for collection.

In this regard, it is preferable to seal and shield the area near the outlets of the gas-jet nozzle orifices 94 or the outlet of the common slit from the ambient atmosphere of the print area of the recording medium to maintain the area near the outlets of the gas-jet nozzle orifices 94 or the outlet of the common slit in a clean condition. Such a configuration prevents a deviation in the direction in which the gas flow 96 is jetted or a local variation in the gas flow blown in the form of air curtain.

Further, it is preferable to maintain the gas flow 96 or the gas flow blown in the form of air curtain in a clean condition. As described above, the orifice size Dg of the gas-jet nozzle orifices 94 is, for example, approximately ϕ8 μm to approximately ϕ25 μm or the size of the common slit in the short direction is, for example, approximately 50 μm to approximately 100 μm. Accordingly, if even a slight amount of dust and/or foreign substances are mixed in the gas flow 96, the dust or foreign substances may clog the gas-jet nozzle orifices 94 or the common slit. In such a case, even if the gas-jet nozzle orifices 94 or the common slit is not fully clogged, such dust or foreign substances may adhere to a portion of the area near the outlets of the gas-jet nozzle orifices 94 or the outlet of the common slit. As a result, the gas flow 96 deviates from a desired direction and fails to hit and drop ink droplets into the gutter 206 or the gas flow blown in the form of air curtain fails to drop smaller ink droplets into the gutter 206.

To cope with such challenges, the gas flow 96 or the gas flow blown in the form of air curtain has substantially the same degree of cleanness as that of a clean air employed in the field of large-scale integrated circuit (LSI). Specifically, a clean air having been filtered through a so-called filter high-Efficiency articulate air filter (HFPA) to remove dust or foreign substances is blown as the gas flow 96 or the gas flow in the form of air curtain. For example, the clean air has a degree of cleanness required to maintain a clean environment corresponding to class 100 (indicating that there are dust particles having diameters of 0.3 μm or more per cubic feet in the air).

Such a configuration can maintain the area near the outlets of the gas-jet nozzle orifices 94 or the outlet of the common slit in a clean condition. In addition, since the gas flow 96 blown from the gas-jet nozzle orifices 94 or the common slit is clean, such a configuration can prevent failures, such as clogging of the gas-jet nozzle orifices 94 or the common slit, a deviation in the flow direction of the gas flow 96, or a local variation in the flow speed of the gas flow blown in the form of air curtain.

It is to be noted that, as the gas flow 96, for example, a filtered nitrogen gas may be used instead of the filtered clean air.

Next, another feature of the present exemplary embodiment is described below.

Generally, air is a viscous fluid and the flow of air can be classified into two types of flow: laminar flow and turbulent flow. For example, assuming an air flow in a tube, the laminar flow represents an air flow in which fluid particles in different layers inside the tube flow in a direction parallel to the axis of the tube, and the turbulent flow represents an air flow in which fluid particles in different layers inside the tube flow while randomly mixing with each other. Accordingly, if other fluid (e.g., ink droplets) enters in the turbulent flow, the fluid gets mixed up in the random flow, thus being scattered in the flow.

In the above-described examples, if a preferable condition on the jetting of the gas flow 96 is properly selected, unnecessary scattered ink droplets might randomly flow and adhere to the recording medium 300, thus degrading image quality.

Quantitatively, a dimensionless number called Reynolds number is expressed by the following equation 1:

$$R=ud/\gamma$$

where γ, u, and d represent a dynamic viscosity of the fluid, an average flow speed of the fluid, and an inner diameter of the tube, respectively. The laminar flow represents an air flow having a Reynolds number not greater than a threshold, and the turbulent flow represents an air flow having a Reynolds number greater than the threshold. The Reynolds number obtained when the air flow shifts from the turbulent flow to the laminar flow or from the laminar flow to the turbulent flow is called critical Reynolds number (Rc). Through academic studies, the critical Reynolds number (Rc) is set to 2310. The critical Reynolds number typically means a lower-limit of critical Reynolds number. Likewise, in the following description, values of RC represent lower-limits of critical Reynolds number.

To create such laminar flow, for example, when the inner diameter d of the tube is 0.015 mm, at 1 atmospheric pressure and 20° C., the dynamic viscosity γ is approximately $149.2\times10^{-7}$ $m^2/s$. When the above-described equation 1 is transformed and the above-mentioned values are substituted into the transformed equation 1, the following equation 2 is obtained $$\begin{aligned} u &= Rc\times\gamma/d \\ &= 2310\times149.2\times10^{-7}\ (m^2/s)/0.015\ (mm) \\ &\approx 2.3\ (m/s) \end{aligned}$$

In other words, for example, in the case in which the gas flow 96 is blown from the gas-jet nozzle orifices 94 independent of each other, when the opening size Dg of the gas-jet nozzle orifices 94 is, for example, ϕ15 μm, the pressure of the gas flow is adjusted at the pressurized-air-flow inlet 95 so that the gas flow passes through a thickness (in-depth) portion of, for example, 5 μm to 30 μm at approximately 2.3 m/s or lower. With such a configuration, the gas flow passing the gas-jet nozzle orifices 94 is not greater than a lower-limit of critical Reynolds number, thus creating a laminar flow. Thus, such a configuration prevents occurrences of unnecessary eddy or random flow.

In other words, unnecessary eddy or random flow can be prevented by setting a combination of the size of gas-jet nozzle and the gas flow speed so that the gas flow is not greater than the lower-limit of critical Reynolds number at least when the gas flow passes through the gas-jet nozzle orifices 94. Since it may need some efforts to perform such setting on an actual apparatus, a flow visualization device and a component corresponding to the gas-jet nozzle orifice 94 may be separately prepared to see a state of the laminar flow at the area near the outlet by using, for example, cigarettes smoke (having particle size of 1 μm or lower) or dry ice as a tracer.

Further, in the case in which the common slit is employed instead of the gas-jet nozzle orifices 94, a similar concept is adopted and a proper condition is selected to prevent unnecessary eddy or random flow from occurring in the gas flow blown in the form of air curtain. In such a case, whether the proper condition is obtained or not can be confirmed with the above-described tracer.

Next, still another feature is described.

As described above, in the present exemplary embodiment, the continuous-stream-type multi-nozzle inkjet recording apparatus is employed unlike a continuous-stream-type inkjet recording apparatus employing electrostatic charging devices like that described in U.S. Pat. No. 3,373,437. Therefore, electrostatic charging devices corresponding to respective nozzles are not needed. For such a conventional continuous-stream-type inkjet recording apparatus employing electrostatic charging devices, nozzles are arrayed at a density corresponding to a print density of at most 50 dpi. By contrast, for the continuous-stream-type multi-nozzle inkjet recording apparatus according to the present exemplary embodiment, nozzles can be arrayed at a density corresponding to a print density of 600 dpi to 2400 dpi, thus obtaining a high image quality at the print density corresponding to the nozzle arrangement. However, such high density nozzle arrangement may impose a specific challenge.

For example, assume that n nozzles are arrayed in a line, where n is a natural number of 3 or greater. In such a case, a jet (ink-droplet stream) emitted from a first nozzle and a jet emitted from a nth nozzle differ from jets from the other nozzles from a second nozzle to a (n−1)th nozzle in their surrounding environments. In other words, the jet emitted from each of the first nozzle and the nth nozzle has an adjacent jet at one side and no adjacent jet and only air at the opposite side.

By contrast, the jet from each of the other nozzles from the second nozzle to the (n−1)th nozzle has adjacent jets at both sides. That is, when jets are emitted from all nozzles from the first nozzle to the nth nozzle, the amount of air resistance received by the jet emitted from each of the other nozzles from the second nozzle to the (n−1)th nozzle slightly decrease due to jetting of the adjacent jets.

By contrast, the jets emitted from each of the first and nth nozzles has only air at one side and receives resistance from the air. As a result, the speed of the jets emitted from the first and nth nozzles tend to be lower than the speed of the jets emitted from the other nozzles from the second nozzle to the (n−1)th nozzle. This phenomenon is similar to a phenomenon observed in swimming races in which swimmers swimming lanes on both ends of a course tend to receive more water resistance and be more disadvantageous than swimmers swimming the other lanes.

To cope with such a challenge, in the present exemplary embodiment, for example, in a case in which n nozzles are arrayed in a line, jets emitted from nozzles from the second nozzle to the (n−1)th nozzle are actually used for printing. Jets from the first and nth nozzles are not used for printing and collected into the gutter 206 as the dummy jets. In other words, the jets from the first and nth nozzles are emitted only for preventing jets from the second and (n−1)th nozzles from receiving air resistance.

In other words, one inkjet nozzle on each end of the inkjet nozzle area for printing is used as dummy nozzle. More preferably, jets from the first and second nozzles and the (n−1)th and nth nozzles are used as dummy while jets from the other nozzles from the third nozzle to the (n−2)th nozzle are used for actual printing. Thus, in the present exemplary embodiment, one or more inkjet nozzles on each end of the inkjet nozzle area for printing are used as dummy inkjet nozzles.

Such dummy jets also are influenced by, for example, ink droplet formation and deflection in a way similar to the jets used for printing and collected by application of the gas flow into the gutter 206. Therefore, such dummy jets are provided with corresponding heaters and gas-jet nozzles as with the jets used for printing.

In the case in which large and small ink droplets are formed and the gas flow is blown from the common slit, all dummy jets need be collected into the gutter 206. Hence, small ink droplets are formed from the dummy jets, deflected by the gas flow blown in the form of air curtain, and reliably collected into the gutter 206.

As described above, in the present exemplary embodiment, dummy jets assist the jets used for actual printing so that the jets used for actual printing can be emitted at a uniform speed. Such dummy jets are useful because, in the present exemplary embodiment, inkjet nozzles can be arrayed at a high density corresponding to a print density of 600 dpi to 2400 dpi. By contrast, for the conventional continuous-stream-type inkjet recording apparatus employing electrostatic charging devices, since inkjet nozzles are arrayed in a density corresponding to a print density of at most 50 dpi, adjacent jets are sufficiently away from each other. As a result, the jets from the inkjet nozzles substantially uniformly receive air resistance.

Accordingly, providing the dummy jets as in the present exemplary embodiment are not so effective for the conventional continuous-stream-type inkjet recording apparatus employing electrostatic charging devices in which inkjet nozzles are arrayed in a density corresponding to a print density of at most 50 dpi.

Further, in the present exemplary embodiment, if the inkjet nozzle orifices are arrayed at a density corresponding to a print density of approximately 50 dpi, providing the dummy jets is not so effective as in the case with the conventional continuous-stream-type inkjet recording apparatus employing electrostatic charging devices. In other words, the dummy jets are effective in particular in the case in which, to maximize the above-described advantage, the inkjet nozzles are arrayed in a high density corresponding to 600 dpi to 2400 dpi.

In accordance with the nozzle arrangement, in the present exemplary embodiment, the gutter 206 serving as an ink collection unit has a size sufficiently to catch ink droplets of ink streams jetted from one or more inkjet nozzle orifices at each end of the inkjet nozzle area. In other words, the length of the gutter 206 in the direction in which the inkjet nozzle orifices are arrayed is sufficiently large relative to the width of the inkjet nozzle area. Further, the common cap unit for the gas-jet nozzle orifices and the inkjet nozzle orifices has a size sufficiently to cover one or more inkjet nozzle orifices at each end of the inkjet nozzle area and the corresponding one or more gas-jet nozzle orifices. In other words, the length of the common cap unit in the direction in which the inkjet nozzle orifices are arrayed is sufficiently large relative to both the width of the inkjet nozzle area and the width of gas-jet nozzle area.

Next, another feature of the present exemplary embodiment is described below.

In the continuous-stream-type multi-nozzle inkjet recording apparatus according to the present exemplary embodiment, ink droplets used for printing are adhered to the recording medium 300 and ink droplets not used for printing are collected in the gutter 206.

While the ink droplets to be collected in the gutter 206 fly in the air as minute ink droplets, moisture or solvent component evaporates from aqueous ink or solvent ink, respectively. Accordingly, the collected ink tends to have a high viscosity. Typically, such high-viscosity ink is discarded. By contrast, in the present exemplary embodiment, the collected ink is returned to the ink supply unit 418 by the ink collection-and-reuse unit 416 illustrated in FIG. 1.

At this time, since the condition for particulating the high-viscosity collected ink differs from the condition for particulating the original ink, ink droplets formed from the high-viscosity collected ink are not the same as the ink droplets formed from the original ink.

Hence, in the present exemplary embodiment, the ink collection-and-reuse unit 416 adds water or solvent to the high-viscosity collected ink to reduce the viscosity of the collected ink (to the same degree of viscosity of the original ink). At this time, a viscosity detector is used to detect the viscosity of the collected ink, thus allowing optimization of the viscosity of the collected ink returned to the ink supply unit 418. In addition, the collected ink is not only highly viscous but also includes, e.g., cellulose 100, fine particle powder 101, fibrous substances 102, and particulate substances 103 illustrated in FIG. 5.

Hence, in the present exemplary embodiment, the ink collection-and-recycle unit 416 has a filter to filter such foreign substances to reuse the collected ink.

Next, still another feature is described below.

The continuous-stream-type multi-nozzle inkjet recording apparatus according to the present exemplary embodiment jets ink droplets from multiple nozzles and highly-precisely controls the ink droplets for high-quality printing with a print density of 600 dpi to 2400 dpi. Therefore, a continuous ink stream jetted from each inkjet nozzle orifice and an ink-droplet stream formed at the fore part thereof need be cut and separated at a desired timing into ink droplets without being deflected from an originally-intended position.

Figure 11:
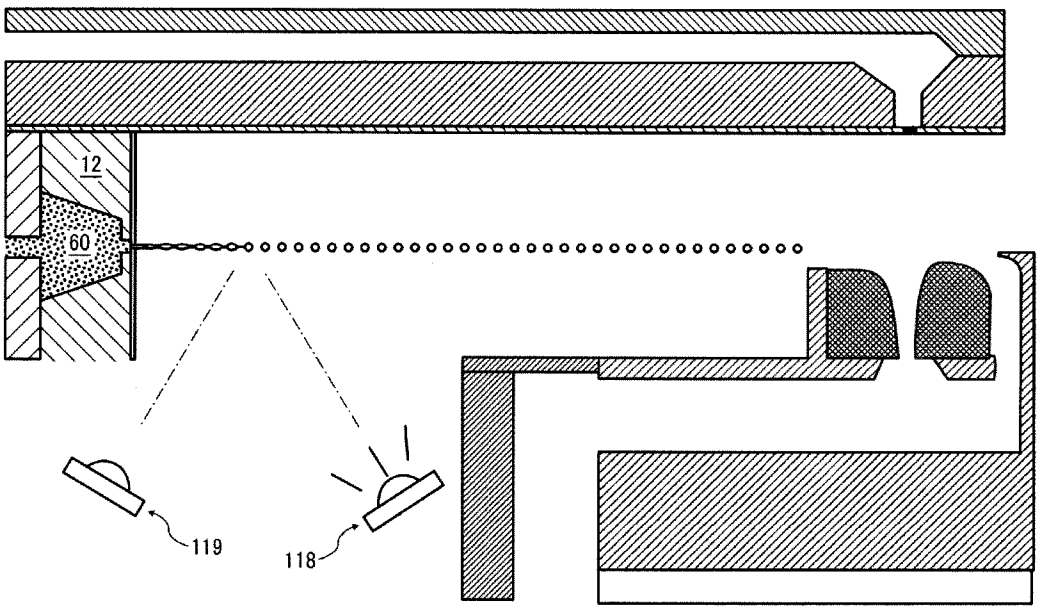
FIG. 11 is a schematic view of a configuration to detect a faulty deflection in a jetting direction of ink droplets in the liquid-jet recording head unit according to the present exemplary embodiment.

Hence, to monitor and check the separation state of ink droplets, in the present exemplary embodiment, for example, as illustrated in FIG. 11, a light emitter and a light receiver 119 are disposed to emit light to the continuous ink stream and ink droplets and receive light reflected from the continuous ink stream and ink droplets, thus detecting a faulty deflection in the direction in which the continuous ink stream and ink droplets are jetted. In FIG. 11, an alternate long-and-short dashed line indicates an optical axis of the optical system for light emission/receiving. It is to be noted that the positions of the light emitter 118 and the light receiver 119 are not limited to those illustrated in FIG. 11. For example, the light emitter 118 and the light receiver 119 to detect a transmitted light are opposed to each other via the continuous ink stream or ink droplets to detect a faulty deflection in the jetting direction of the continuous ink stream and ink droplets.

The light emitter 118 is a light emitting device such as light emitting diode (LED) or laser diode (LD), and the light receiver 119 is, for example, a photodiode, a charge-coupled-device (CCD) image sensor, or a complementary-metal-oxide-semiconductor (CMOS) image sensor. The light emitter 118 emits a flash light in response to a heater-driving voltage pulse illustrated in FIG. 3 and the light receiver 119 detects a shadow or image of the continuous ink stream or ink droplets. Thus, by emitting flash lights from the light emitter 118 in synchronous with the heater-driving voltage pulse to observe the shadow or image of the continuous ink stream or ink droplets, a standing wave (surface wave) on a surface of the continuous ink stream and respective ink droplet created by the heater-driving voltage pulse can be observed at static state.

Alternatively, instead of the light emitter 118 and the light receiver 119, an image sensor, e.g., a CCD camera may be used as a monitor system to monitor the shadow or image of the continuous ink stream or ink droplets.

Further, a plurality of sets of the light emitters 118 and the light receivers 119 or a plurality of the image sensors may be disposed to monitor all continuous ink streams jetted in the direction in which multiple inkjet nozzles are arrayed in line. Alternatively, the light emitter 118 and the light receiver 119 or the image sensor may be movable in the nozzle array direction to monitor all continuous ink streams jetted in the nozzle array direction.

Figure 12:
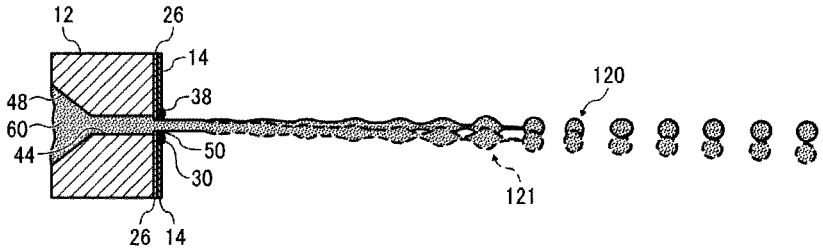
FIG. 12 is a schematic view of an example of faulty deflection in the jet direction of ink droplets in the liquid-jet recording head unit according to the present exemplary embodiment.

FIG. 12 shows a state in which a continuous ink stream is cut into ink droplets.

In this example, an undeflected ink 120 is illustrated as a state in which ink is jetted in a preferable condition to form ink droplets. In addition, a deviated ink 121 is illustrated as an example of ink skewed by some factor (i.e., flying deviated from an intended direction). Typically, such deviated ink 121 is caused by foreign substances adhered to the inkjet nozzle orifice 50. At this time, although the inkjet nozzle orifice 50 is not always fully clogged, such a state is also referred to as clogging in a broad sense.

Another detectable failure is a failure in the length at which the continuous ink stream is cut. Although the failure is also related with the faulty deviation in the jetting direction of ink droplets, even if ink droplets appear to go straight without being deviated by foreign substances adhered to the inkjet nozzle orifice 50, such adhered foreign substances may hamper preferable cutting of the continuous ink stream and separation of ink droplets. As one observed state of the failure, for example, the distance from the outlet of the inkjet nozzle orifice 50 to a position at which the continuous ink stream is actually cut is shortened as compared with an originally-intended position.

Alternatively, bubbles may exist within the inkjet nozzle orifice 50. In such a case, as is the case of natural particulating, ink droplets may not be stably formed. In other words, the cut position of the continuous ink stream is not stable, and the flash light is not emitted in synchronous with the heater-driving voltage pulse, thus hampering observation of ink droplets at a static state. Such a case is also referred to as one type of failure in the cut length of continuous ink stream.

If printing is performed under the condition of the faulty deviation in the jetting direction of ink droplets or the failure in the cut length of continuous ink stream, ink droplets are not accurately landed onto the target positions on the recording medium 300, thus degrading image quality. Hence, under such a condition (of the faulty deviation in the jetting direction of ink droplets or the failure in the cut length of continuous ink stream), it is preferable to stop printing to avoid waste the recording medium and ink. Further, although, in the above-description, the faulty deviation in the jetting direction of ink droplet is referred to as clogging in a broad sense, in the case of clogging in a narrow sense in which the inkjet nozzle orifice 50 is fully clogged by foreign substances or dried ink, it is of course preferable to stop printing.

Thus, in the present exemplary embodiment, when the faulty deviation in the jetting direction of ink droplet occurs or the inkjet nozzle orifice 50 is clogged by foreign substances and/or dried ink (in the narrow or broad sense), printing is stopped and the process goes to a subsequent step to resolve the failure.

As described above, the inkjet nozzle cap unit 112 to collectively cap the multiple inkjet nozzle orifices 50 is illustrated in FIG. 8. In the present exemplary embodiment, the inkjet nozzle cap unit not only caps the multiple inkjet nozzle orifices 50 but also covers the entire area in which the inkjet nozzle orifices 50 are arrayed to suction ink from the inkjet nozzle orifices 50 so as to serve a reliability-recovery-and-maintenance unit. Thus, with the inkjet nozzle orifices 50 capped, for example, partially-solidified dried ink can be suctioned from the outlet side of the inkjet nozzle orifices 50, thus allowing the inkjet nozzle orifices 50 to recover from clogging.

As described above, in the present exemplary embodiment, when the faulty deviation in the jetting direction of ink droplet is detected, printing is stopped and the reliability-recovery-and-maintenance unit is activated in response to detected information of the faulty deviation in the jetting direction of ink droplet. After the faulty deviation in the jetting direction of ink droplet is removed, printing is started. Such a configuration can prevent image degradation due to the faulty deviation in the jetting direction of ink droplet and avoid waste of the recording medium and ink.

Next, ink used for the continuous-stream-type inkjet recording apparatus according to the present exemplary embodiment is described below.

Various types of conventionally-known inks for inkjet printing can be used as the ink in the present exemplary embodiment.

Typically, ink contains a liquid medium, a recording agent to form a print image, and an additive added to obtain a desired property. By properly adjusting the types of the liquid medium and the additive and a composition ratio so that the viscosity of ink is, for example, 0.5 cP to 30 cP (at 20° C.) and the surface tension is, e.g., $1\times10^{-2}$ to $6\times10^{-2}$ N/m (10 to 60 dyn/cm (at 20° C.)), the condition for ink-droplet formation in the present exemplary embodiment can be substantially met.

The continuous-stream-type inkjet recording apparatus according to the present exemplary embodiment differs from the conventional continuous-stream-type inkjet recording apparatus employing electrostatic charging devices in the principles of formation and deflection of ink droplets and has no constraints of the water solubility and conductivity of ink. In other words, if the above-described range of viscosity or surface tension is met, any of aqueous, non-aqueous, dissoluble, conductive, and insulating ink can be preferably used.

Alternatively, a so-called ultra violet (UV) ink (UV curing ink) containing UV curing reaction initiator can be preferably used. Such a UV ink can be immediately cured using a UV irradiation source, such as LED or LD, for irradiating ultraviolet light having a peak of the jet wavelength of, for example, 350 to 420 nm and a highest intensity of illumination of 10 to 1,000 W/cm$^2$ on the surface of the recording medium. Alternatively, a UV LED or UV LD can be employed.

Alternatively, a mercury lamp, a metal halide lamp, a gas laser, or a solid-state laser may be used as another type of activation energy source. Since the continuous-stream-type inkjet recording apparatus according to the present exemplary embodiment can perform high throughput printing, it is preferable to dry or cure ink immediately. Therefore, the UV ink immediately cured by UV irradiation is suitable for the continuous-stream-type inkjet recording apparatus according to the present exemplary embodiment. Further, when the recording agent is in a range of, for example, 0.2 to 10 wt % in the ink to obtain a desired recording density, any of dye and pigment can be used as the recording agent.

Next, still another feature of the present exemplary embodiment is described below.

Of the above-described four types of printing principles, the principle in which large and small ink droplets are formed as print droplets and non-print droplets, respectively is most suitable for the liquid-jet recording apparatus according to the present exemplary embodiment.

Although the principle of printing is described above, when the principle is applied to an actual recording apparatus, there are practical challenges to be solved in order to obtain high quality images. Such three challenges and means for solving the challenges are described below. As described above, since the principle in which large and small ink droplets are formed as print droplets and non-print droplets, respectively is most suitable for the liquid-jet recording apparatus according to the present exemplary embodiment, the following description is given based on the principle. However, it is to be noted that the above-described other three principles is applicable to the liquid-jet recording apparatus according to the present exemplary embodiment and can obtain similar effects.

The first challenge is related to the start-up time of the liquid-jet recording head unit required till large and small ink droplets come to be stably formed. In the present exemplary embodiment, two types of fluid, that is, the ink and gas flow are used. Such fluids are not turned into a desired ink or gas jet stream immediately after the apparatus is powered on, and it takes some time till ink comes to be jetted or a gas flow comes to be formed at a stable constant pressure.

Although heater-drive electric signals to apply thermal stimulation to the continuous ink stream can be applied immediately, it takes some time till such fluid comes to be stably flown at a constant pressure. In other words, it is difficult to generally define a time required till ink or gas flow comes to be stably flown at a constant pressure because the time depends on, for example, the entire size of the flow system and the amount of pressure. However, in the flow system of the liquid-jet recording head unit applicable to the page printer like the present exemplary embodiment, it may take at least approximately 0.1 second after power-on till stable ink jetting and formation of small and large ink droplets comes to be performed. Alternatively, depending on conditions, it may take approximately 10 seconds because a desired stable droplet formation condition is not obtained till ink reaches a desired temperature and viscosity.

Meanwhile, ink droplets are continuously jetted till the liquid-jet recording head unit 10 is stably started up. Such ink droplets do not always go straight till the flying direction becomes stable, and fly along a flying path deviated from the normal flying path, thus staining the surroundings.

Figure 13:
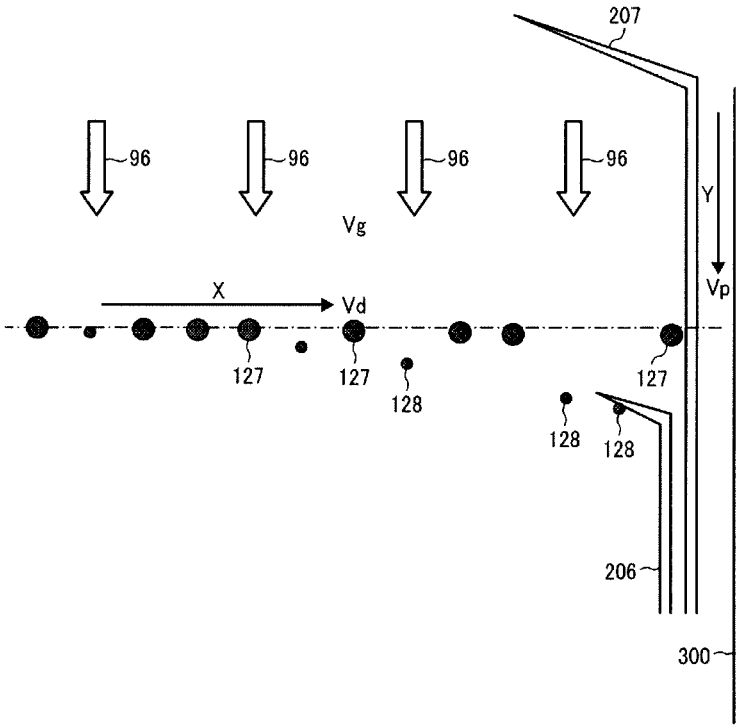
FIG. 13 is a schematic view of a second gutter disposed as another ink collection unit in the liquid-jet recording head unit according to the present exemplary embodiment.
Figure 14:
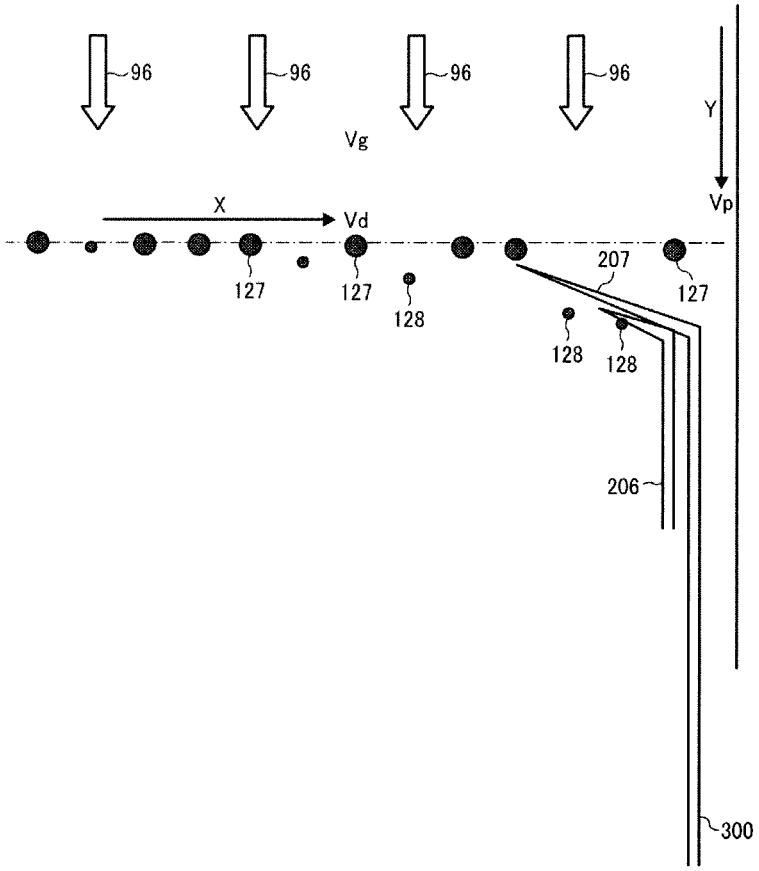
FIG. 14 is a schematic view of a position adjustment of the second gutter of FIG. 13.

To cope with such a challenge, in the present exemplary embodiment, as illustrated in FIG. 13, a second gutter 207 is disposed as another ink collection unit in addition to the ink collection unit illustrated in FIG. 4.

In FIG. 13, besides the gutter 206, the second gutter 207 is disposed to capture and collect unnecessary ink droplets jetted till the liquid-jet recording head unit 10 is stably started up.

The second gutter 207 blocks a flying path along which large ink droplets fly at a stable state (indicated by an alternate dash-and-dot line in FIG. 13) to securely capture and collect unnecessary ink droplets.

The position of the second gutter 207 is adjustable and can be moved downward so that printing can be normally performed after the liquid-jet recording head unit 10 has been stably started up. Alternatively, the position of the gutter 206 may be adjustable up and down so that the single gutter 206 can also perform the function of the second gutter 207 instead of the second gutter 207.

Further, the common cap unit 114 commonly used for the gas-jet nozzle orifices and the inkjet nozzle orifices illustrated in FIGS. 9 and 10 may include a moving structure to adjust the position thereof and also serve as a gutter mechanism to capture and collect unnecessary ink droplets.

The second practical challenge is image degradation due to minute floating mist. As described above, in the present exemplary embodiment, non-print droplets (small droplets 128) are collected by the gutter 206. The small droplets 128 fly and impinge the gutter 206 at a relatively high speed of, for example, 15 to 30 m/s. As a result, the small droplets 128 break up into ink mist floating around the gutter 206. Further, the mist may drift toward the recording medium and adhere on the surface of the recording medium, thus causing image degradation (referred to as background stain).

Figure 15:
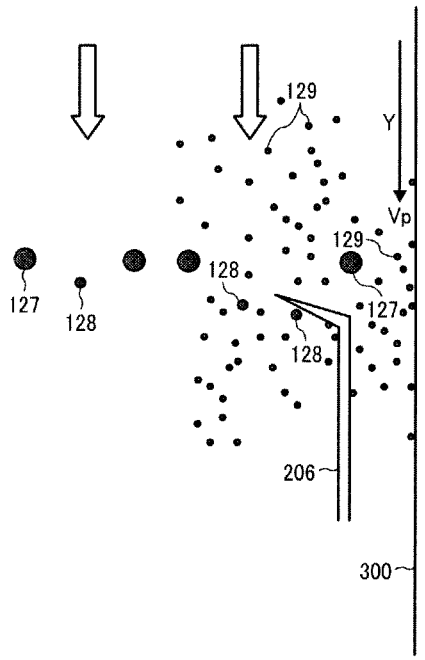
FIG. 15 is an enlarged view of an area near the gutter and the recording medium of FIG. 4 in which ink mist floats.

FIG. 15 illustrates an example of background stain of the recording medium.

FIG. 15 is also an enlarged view of an area near the gutter 206 and the recording medium 300. Floating mist 129 are created by splitting of the small ink droplets 128 caused when the small ink droplets 128 flying toward the gutter 206 for collection impinge the gutter 206. Some of the floating mist 129 float near the area and are collected downward by the gas flow 96, and others of the floating mist 129 adhere to the recording medium 300, thus causing image degradation as background stain.

To cope with such a challenge, in the present exemplary embodiment, such background stain due to the floating mist 129 can be prevented, thus obtaining high quality image. Hence, in the present exemplary embodiment, the liquid-jet recording head unit has a structure to prevent the floating mist 129 illustrated in FIG. 15 from moving toward a recording face of the recording medium 300. Specifically, the liquid-jet recording head unit has a structure to prevent the floating mist 129 from moving toward the recording medium 300 from a fore end of the gutter 206 of FIG. 2, that is, the opening area of a slit shape extending in the nozzle array direction (the direction perpendicular to the width direction i.e., conveyance direction of the recording medium 300) and close to the recording medium 300 when the liquid-jet recording head is seen from the position of the recording medium 300.

Figure 16:
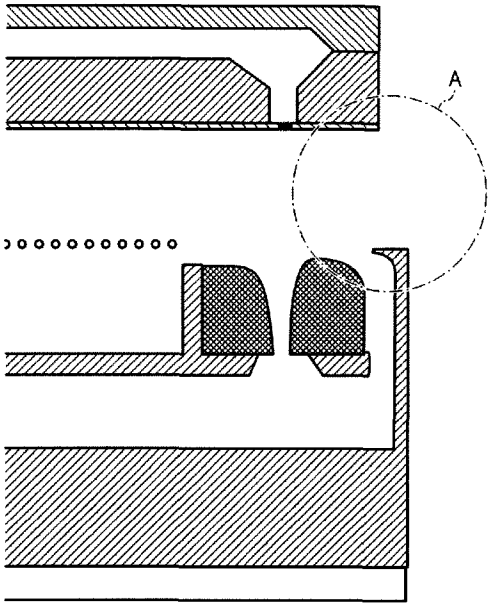
FIG. 16 is an enlarged view of an opening area of a slit shape illustrated in FIG. 2.

That is, the area A illustrated in FIG. 16 is a long-and-narrow opening of a slit shape extending in the vertical (depth) direction relative to the flat face of a sheet on which FIG. 16 is printed, and a large mass of print droplets (large droplets) 127 not collected into the gutter 206 fly out from the area A to adhere to the recording medium 300. By contrast, the floating mist 129 is prevented from moving from the opening of the slit shape toward the recording medium 300.

Figure 17:
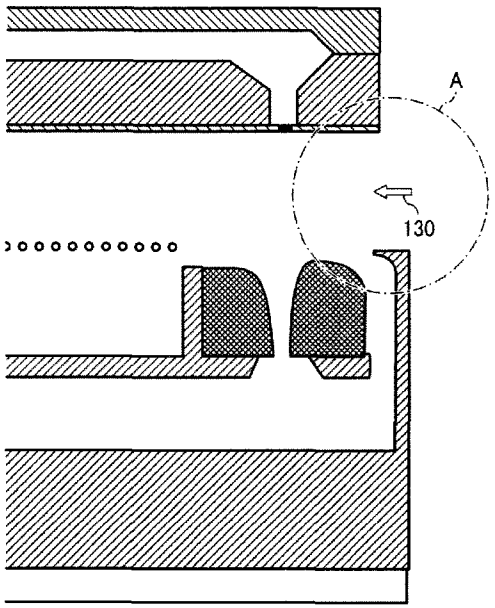
FIG. 17 is a schematic view of a state in which a velocity vector of an air flow formed in the opening area of the slit shape is directed inward from the opening area.

A measure to cope with the floating mist is illustrated in FIG. 17. FIG. 17 shows a velocity vector 130 of an air flow generated in the area A. Specifically, in the present exemplary embodiment, in the area A forming an opening silt (a long-and-narrow opening along a vertical direction or depth direction relative to the printed sheet face of FIG. 17), an air near the area A not only floats and is forcefully flown in a certain direction so that the velocity vector 130 of the air flow is directed from the opening area inward from the opening area (toward the liquid-jet recording head, i.e., in a direction opposite the flying direction of ink droplets).

Figure 18:
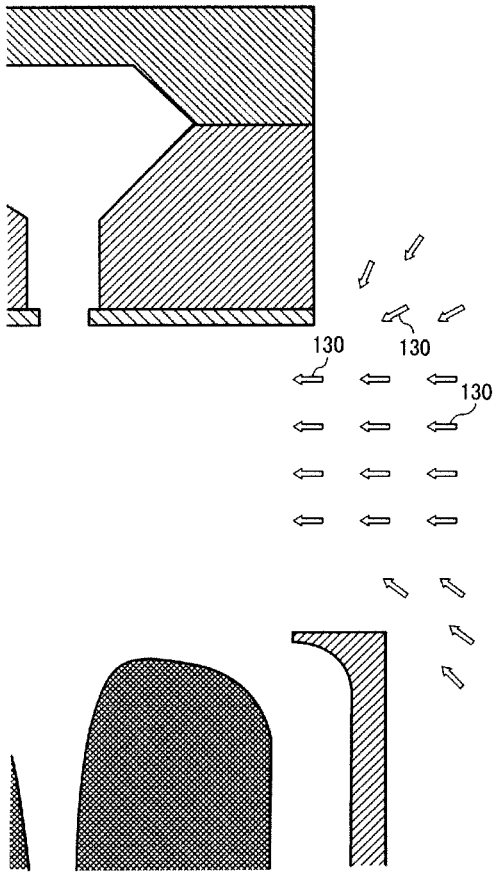
FIG. 18 is a schematic view of detailed directions of the velocity vector of the air flow.

In FIG. 18, the area A is further enlarged to illustrate velocity vectors of nearby air flows in detail. Even if the floating mist moves outside the opening area, the velocity vector 130 forms the air flow moving inward from the opening area. As a result, the floating mist moves with the air flow inward from the opening area, thus preventing adherence to the recording medium, i.e., background stain. It can be confirmed using cigarettes smoke (of a particle size of 1 μm or less) or dry ice as tracer whether or not the velocity vector of the air flow is directed inward from the opening area.

As described above, in the present exemplary embodiment, the air flow is purposely created to suction the floating mist 129, which is generated when the small ink droplets 128 (non-print droplets) impinge the gutter 206, by at least a suction force sufficient to keep the floating mist 129 within the opening area A of a slit shape.

The flying ink droplets 127 and 128 drag surrounding air to create another air flow around them along the flying direction thereof. In other words, the above-described air flow is purposely created to suction the another air flow created along the flying direction of the flying ink droplets 127 and 128 by at least a suction force sufficient to reflux the another air flow.

For example, a fan or a vacuum suction pump may be provided at a suction slot 212 or an ink collection-and-suction portion 208 connected to the ink collection passage 202 illustrated in FIG. 2 to create the air flow at such a suction force. Alternatively, separately, an exhaust channel may be provided with, for example, a fan or a vacuum suction pump to create the air flow.

As described above, in the present exemplary embodiment, the air flow is purposely created to suction inward from the opening area A the floating mist 129 generated when the small ink droplets 128 (non-print droplets) impinge the gutter 206, thus preventing the floating mist 129 from moving outside the opening area A. Next, as the third practical challenge, a process in which the above-described technique is actually applied to the liquid-jet recording apparatus is described below.

A system of handling fluid in such a way as in the present exemplary embodiment, the speed of response is slow relative to electric signal and operation is performed after a time lag.

Likewise, in the system according to the present exemplary embodiment in which the air flow is purposely created to suction the floating mist 129 inward from the opening area to prevent the floating mist 129 from moving outside the opening area, it may take, for example, approximately 1 to 10 seconds till the system comes to stably suction the mist. Since the floating mist 129 floats around the opening area till the system reaches such a stable state, if the recording medium is conveyed to the print area, the floating mist 129 may cause background stain of the recording medium.

To cope with such a challenge, in the present exemplary embodiment, in the above-described configuration in which the liquid-jet recording head unit purposely creates the air flow in the opening area to prevent the floating mist 129 from moving outward from the opening area, it is only after movement of the floating mist 129 outward from the opening area is securely prevented, that is, the above-described suction is stably performed that the recording medium is conveyed to the fore side of the print area to start printing. Such a configuration securely suctions the floating mist 129, thus preventing the floating mist 129 from floating outside the opening area and causing background stain of the recording medium.

The above-described challenge of the floating mist is caused by the break-up of ink droplets impinging the gutter 206. Therefore, the challenge is more concerned with the above-described other three printing principles than the printing principle in which the small ink droplets 128 (non-print droplets) impinge the gutter 206, because print droplets and non-print droplets have the same size and a larger mass than the small ink droplets 128. Accordingly, the effect obtained by the present exemplary embodiment is greater in the other three printing principles than in the principle in which the small ink droplets 128 are impinge the gutter 206.

Next, still another feature of the present exemplary embodiment is described below.

As described above, in the present exemplary embodiment, the challenge of background stain caused by the floating mist can be solved. However, in the present exemplary embodiment, an additional safety measure is provided. Although leaking of the floating mist from the opening area is basically prevented, in the present exemplary embodiment, since ink droplets fly at a speed of, for example, 15 to 30 m/s and impinge the recording medium, most of the ink droplets are used for image formation in the form of picture elements on the recording medium. Meanwhile, a portion of the ink droplets may break up into ink mist and adhere on the surface of the recording medium, thus causing background stain.

Although, in normal conditions, the above-described floating mist does not leak from the opening area, for example, an unexpended accident might cause such leaking of the floating mist from the opening area.

Hence, to cope with such a challenge, in the present exemplary embodiment, another air flow is created between the liquid-jet recording head unit 10 so that a velocity vector of the air flow is directed in the conveyance direction of the recording medium 300. For example, as illustrated in FIG. 2, when the recording medium 300 is convened to the direction indicated by the arrow at the speed Vp, the air flow is created in the same direction as the conveyance direction of the recording medium 300. Thus, even if mist exists between the liquid-jet recording head unit 10 and the recording medium 300, the mist is immediately moved and diffused without floating therebetween, thus preventing background stain at a certain position of the recording medium. It is to be noted that the conveyance direction of the recording medium 300 may be opposite the direction indicated by the arrow in FIG. 2. In such a case, the conveyance direction of the recording medium is also the same as the direction of the air flow, thus effectively moving and diffusing ink mist from the print area.

In such a case, ink mist is only moved and diffused from the print area and not collected. Microscopically, although a portion of ink mist might adhere to somewhere on the recording medium 300, the amount of ink mist adhered is extremely low and hardly recognized as background stain. To direct the velocity vector of the air flow in the conveyance direction of the recording medium 300, a blower unit, such as a fan, and a duct allowing an air flow to flow in this area may be disposed to blow or suction air.

As described above, a liquid-jet recording apparatus according to at least one exemplary embodiment of the present disclosure includes a liquid-jet recording head unit to jet ink droplets toward a recording medium at a stationary state relative to the recording medium during printing, the liquid-jet recording head unit including an opening area through which the ink droplets fly out from the liquid-jet recording head unit; and a conveyance unit to convey the recording medium to a fore side of the opening area of the liquid-jet recording head unit. The liquid-jet recording head unit includes a multi-nozzle inkjet head having multiple inkjet nozzles, pressurizing ink, and emitting a plurality of continuous streams of an ink; a separation unit that stimulates surface of the continuous stream of ink and causes surface waves on the continuous stream of ink so that the continuous stream of ink breaks up into streams of flying ink droplets; a gas-flow application unit to apply a gas flow to the flying ink droplets from a substantially-vertical direction relative to a flying direction of the flying ink droplets; and a gutter unit to catch as non-print droplets first ink droplets of the flying ink droplets having a flying path deflected by the gas flow. Second ink droplets of the flying ink droplets having a flying path not substantially deflected by the gas flow hit the recording medium as print droplets without being caught by the gutter unit. The opening area through which the print droplets fly out from the liquid-jet recording head unit has a slit shape extending along a direction in which the multiple inkjet nozzles are arrayed, and an air flow generated in the opening area has a velocity vector directed inward from the opening area. Such a configuration can prevent ink mist specific to the liquid-jet recording apparatus according to the new principle described in the exemplary embodiment of the present disclosure from moving toward the surface of the recording medium. As a result, background stain of the recording medium due to mist can be prevented, thus obtaining high-quality image and allowing high-quality printing.

In the liquid-jet recording apparatus according to at least one exemplary embodiment of the present disclosure, when the continuous stream of ink is broken up into streams of droplets, large and small ink droplets is selectively formed in accordance with print information, a flying path of the small ink droplets is deflected so that the small ink droplets are caught in the gutter unit, and a flying path of the large ink droplets is not substantially deflected so that the large ink droplets are used for printing. Accordingly, as with the above-described effect, such a configuration also prevent ink mist from moving toward the surface of the recording medium. As a result, background stain of the recording medium due to mist can be prevented, thus obtaining high-quality image and allowing high-quality printing.

In at least one exemplary embodiment of the present disclosure, the liquid-jet recording apparatus includes a second gutter unit to catch the large ink droplets till the large ink droplets come to be stably usable for printing when the large ink droplets are generated by the liquid-jet recording head unit. In at least one exemplary embodiment of the present disclosure, the liquid-jet recording apparatus can perform considerably higher throughput than a conventional the inkjet recording apparatus (that is, print a greater number of sheets per unit time). Accordingly, if defective printing is performed at an unstable state, a great amount of the recording media may be wasted. Thus, the above-described configuration can produce considerable effect.

Further, in the liquid-jet recording apparatus according to at least one exemplary embodiment of the present disclosure, the second gutter unit includes a capture unit capable of adjusting a position thereof to block the flying path of the large ink droplets and capture the large ink droplets. Such a configuration allows the liquid-jet recording apparatus to adjust the position of the capture unit and start printing after the head unit reaches a stably printable state.

In at least one exemplary embodiment of the present disclosure, the liquid-jet recording apparatus includes a gas-flow opening disposed in the gas-flow application unit, through which the gas flow is blown; and a cap unit to shield the gas-flow opening, when printing is not performed, from an ambient atmosphere of the fore side of the opening area to which the recording medium is conveyed for printing. Such a configuration can prevent, for example, paper powder, fine particle powder coated on the surface of sheet of paper, and/or dust floating in the ambient atmosphere from adhering to the gas-flow opening through which the gas flow is jetted, and can eliminate factors that may hamper preferable jetting of the gas flow. Further, such a configuration can securely achieve stable operation of the liquid-jet recording apparatus employing the new liquid-jet principle and perform high-volume printing at higher speed than a conventional liquid-jet recording apparatus.

In the liquid-jet recording apparatus according to at least one exemplary embodiment of the present disclosure, the cap unit is also the capture unit capable of adjusting a position thereof to block the flying path of the large ink droplets and capture the large ink droplets. Thus, in addition to the above-described effects, an effect of simplifying the apparatus structure can be obtained.

In the liquid-jet recording apparatus according to at least one exemplary embodiment of the present disclosure, the air flow carries ink mist generated by the non-print droplets impinging the gutter unit inward from the opening area by at least a suction force sufficient to keep the ink mist within the opening area without moving the ink mist outward from the opening area.

In the liquid-jet recording apparatus according to at least one exemplary embodiment of the present disclosure, the air flow is generated inward from the opening area by a suction force sufficient to reflux a second air flow generated by the flying ink droplets around the flying ink droplets in the flying direction of the flying ink droplets. Such a configuration prevents ink mist from moving toward the surface of the recording medium. As a result, background stain of the recording medium due to mist can be prevented, thus obtaining high-quality image and allowing high-quality printing.

In the liquid-jet recording apparatus according to at least one exemplary embodiment of the present disclosure, after the air flow is generated in the opening area by the liquid-jet recording head unit, the recording medium is conveyed to the fore side of the print area and printing is started.

In the liquid-jet recording apparatus according to at least one exemplary embodiment of the present disclosure, a third air flow created between the liquid-jet recording head unit and the recording medium has a velocity vector directed in a direction in which the recording medium is conveyed. With such a configuration, even if an unexpected event causes unnecessary mist to leak from the opening slit, the air flow can immediately direct the mist in the conveyance direction of the recording medium. Accordingly, such unnecessary mist cannot stay and cause background stain of the recording medium, thus allowing high-quality image printing. Further, such a configuration can immediately remove minute mist generated by print droplets impinging and adhering to the recording medium during printing, thus preventing background stain and allowing high-quality image printing.

In at least one exemplary embodiment of the present disclosure, the liquid-jet recording apparatus includes a suction unit or a blower unit to direct the velocity vector of the third air flow between the liquid-jet recording head unit and the recording medium in the direction in which the recording medium is conveyed. Thus, as with the above-described effect, even if an unexpected event causes unnecessary mist to leak from the opening slit, the air flow can immediately direct the mist in the conveyance direction of the recording medium. Accordingly, such unnecessary mist cannot stay and cause background stain of the recording medium, thus allowing high-quality image printing. Further, such a configuration can immediately remove minute mist generated by print droplets impinging and adhering to the recording medium during printing, thus preventing background stain and allowing high-quality image printing.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid-jet recording apparatus, comprising:

a liquid-jet recording head unit to jet ink droplets toward a recording medium for printing, the liquid-jet recording head unit comprising an opening area through which the ink droplets fly out from the liquid-jet recording head unit; and a conveyance unit to convey the recording medium to a fore side of the opening area of the liquid-jet recording head unit, the liquid-jet recording head unit, comprising:

a multi-nozzle inkjet head comprising multiple inkjet nozzles, the multi-nozzle inkjet head pressurizing ink and emitting a plurality of continuous streams of an ink;

a separation unit that stimulates surface of the continuous stream of ink and causes surface waves on the continuous stream of ink so that the continuous stream of ink breaks up into streams of flying ink droplets;

a gas-flow application unit to apply a gas flow to the flying ink droplets from a substantially-vertical direction relative to a flying direction of the flying ink droplets; and a gutter unit to catch as non-print droplets first ink droplets of the flying ink droplets having a flying path deflected by the gas flow, wherein second ink droplets of the flying ink droplets having a flying path not substantially deflected by the gas flow hit the recording medium as print droplets without being caught by the gutter unit, the opening area through which the print droplets fly out from the liquid-jet recording head unit has a slit shape extending along a nozzle array arrangement direction in which the multiple inkjet nozzles are arrayed, the liquid-jet recording head unit is configured with at least one nozzle at each end of the nozzle array being a dummy nozzle that emits a continuous stream that is broken up by the separation unit into flying ink droplets that are non-print droplets, are deflected by the gas flow and are collected in the gutter unit, while the remaining nozzles emit respective continuous streams of print droplets and are assisted by the dummy nozzles such that the continuous streams of print droplets emitted by the remaining nozzle for printing have a uniform speed, and the continuous stream emitted by the dummy nozzle reduces air resistance to which the continuous streams emitted by the remaining nozzles are subjected, and an air flow generated in the opening area has a velocity vector directed inward from the opening area.

2. The liquid-jet recording apparatus according to claim 1, wherein, when the continuous stream of ink is broken up into streams of droplets, large and small ink droplets are selectively formed in accordance with print information, a flying path of the small ink droplets is deflected so that the small ink droplets are caught in the gutter unit, and a flying path of the large ink droplets is not substantially deflected so that the large ink droplets are used for printing.

3. The liquid-jet recording apparatus according to claim 2, further comprising a second gutter unit to catch the large ink droplets till the large ink droplets come to be stably usable for printing when the large ink droplets are generated by the liquid-jet recording head unit.

4. The liquid-jet recording apparatus according to claim 3, wherein the second gutter unit comprises a capture unit capable of adjusting a position thereof to block the flying path of the large ink droplets and capture the large ink droplets.

5. The liquid-jet recording apparatus according to claim 1, further comprising:

a gas-flow opening disposed in the gas-flow application unit, through which the gas flow is blown; and a cap unit to shield the gas-flow opening, when printing is not performed, from an ambient atmosphere of the fore side of the opening area to which the recording medium is conveyed for printing.

6. The liquid-jet recording apparatus according to claim 5, wherein the cap unit is also a capture unit capable of adjusting a position thereof to block the flying path of the large ink droplets and capture the large ink droplets.

7. The liquid-jet recording apparatus according to claim 1, wherein the air flow carries ink mist generated by the non-print droplets impinging the gutter unit inward from the opening area by at least a suction force sufficient to keep the ink mist within the opening area without moving the ink mist outward from the opening area.

8. The liquid-jet recording apparatus according to claim 1, wherein the air flow is generated inward from the opening area by a suction force sufficient to reflux a second air flow generated by the flying ink droplets around the flying ink droplets in the flying direction of the flying ink droplets.

9. The liquid-jet recording apparatus according to claim 1, wherein, after the air flow is generated in the opening area by the liquid-jet recording head unit, the recording medium is conveyed to the fore side of the print ea and printing is started.

10. The liquid-jet recording apparatus according to claim 1, wherein a third air flow created between the liquid-jet recording head unit and the recording medium has a velocity vector directed in a direction in which the recording medium is conveyed.

11. The liquid-jet recording apparatus according to claim 10, further comprising a suction unit to direct the velocity vector of the third air flow between the liquid-jet recording head unit and the recording medium in the direction in which the recording medium is conveyed.

12. The liquid-jet recording apparatus according to claim 10, further comprising a blower unit to direct the velocity vector of the third air flow between the liquid-jet recording head unit and the recording medium in the direction in which the recording medium is conveyed.

13. The liquid-jet recording apparatus according to claim 1, wherein each of two nozzles at each end of the nozzle array is a dummy nozzle configured to emit a continuous stream that is broken up by the separation unit into flying ink droplets that are non-print droplets.

14. The liquid-jet recording apparatus according to claim 1, wherein all of the flying ink droplets that are broken up by the separation unit from the continuous stream emitted by the dummy nozzle are non-print droplets collected by the gutter unit.

15. A liquid-jet recording apparatus, comprising a liquid-jet recording head unit to jet ink droplets toward a recording medium for printing, the liquid-jet recording head unit comprising an opening area through which the ink droplets fly out from the liquid-jet recording head unit, wherein the liquid-jet recording head unit comprises:

an inkjet head comprising multiple inkjet nozzles arranged to emit a plurality of continuous streams of an ink;

a separation unit that stimulates surface of the continuous stream of ink and causes surface waves on the continuous stream of ink so that the continuous stream of ink breaks up into streams of flying ink droplets;

a gas-flow application unit to apply a gas flow to the flying ink droplets from a substantially-vertical direction relative to a flying direction of the flying ink droplets; and a gutter unit to catch as non-print droplets first ink droplets of the flying ink droplets having a flying path deflected by the gas flow, wherein second ink droplets of the flying ink droplets having a flying path not substantially deflected by the gas flow hit the recording medium as print droplets without being caught by the gutter unit, the opening area through which the print droplets fly out from the liquid-jet recording head unit has a slit shape extending along a nozzle array arrangement direction in which the multiple inkjet nozzles are arrayed, the liquid-jet recording head unit is configured with at least one nozzle at each end of the nozzle array being a dummy nozzle that emits a continuous stream that is broken up by the separation unit into flying ink droplets that are non-print droplets, are deflected by the gas flow and are collected in the gutter unit, while the remaining nozzles emit respective continuous streams of print droplets and are assisted by the dummy nozzles such that the continuous streams of print droplets emitted by the remaining nozzles for printing have a uniform speed, and the continuous stream emitted by the dummy nozzle reduces air resistance to which the continuous streams emitted by the remaining nozzles are subjected, and an air flow generated in the opening area has a velocity vector directed inward from the opening area.

* * * * *